US007287993B2

(12) United States Patent
Fujii et al.

(10) Patent No.: US 7,287,993 B2
(45) Date of Patent: Oct. 30, 2007

(54) CONNECTOR HAVING A MOVABLE MEMBER

(75) Inventors: Masayasu Fujii, Yokkaichi (JP); Toshikazu Sakurai, Yokkaichi (JP); Yukihiro Fukatsu, Yokkaichi (JP); Toshikazu Saba, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/529,165

(22) Filed: Sep. 28, 2006

(65) Prior Publication Data

US 2007/0082549 A1 Apr. 12, 2007

(30) Foreign Application Priority Data

Sep. 29, 2005 (JP) ..... 2005-285121
Oct. 12, 2005 (JP) ..... 2005-297748

(51) Int. Cl.
*H01R 13/13* (2006.01)

(52) U.S. Cl. ..... 439/157

(58) Field of Classification Search ..... 439/157, 439/159, 158, 160
See application file for complete search history.

(56) References Cited

U.S. PATENT DOCUMENTS 6,257,922 B1 7/2001 Shinozaki
6,354,852 B2 * 3/2002 Noro et al. ..... 439/157
2003/0162413 A1 8/2003 Shinozaki et al.

FOREIGN PATENT DOCUMENTS

JP 2001-326024 11/2001
JP 2004-030961 1/2004

* cited by examiner

*Primary Examiner*—Phuong Dinh
(74) *Attorney, Agent, or Firm*—Gerald E. Hespos; Anthony J. Casella

(57) ABSTRACT

A lever (40) is mounted rotatably on a female housing (10) and includes a cam plate (47) with a cam groove (41). The cam plate (47) is arranged on only one surface of the female housing (10). In addition to an engaged position of a cam groove (41) and a cam pin (88), a position is set between the lever (40) and a male housing (80) to produce forces to pull the housings (10, 80) towards each other. For example, a hook (43) is formed on a posture correcting arm (46) at a position facing the cam plate (47) of the lever (40) and engages a receiving portion (91) in the male housing (80) to pull the housings (10, 80) together.

7 Claims, 23 Drawing Sheets

CONNECTOR HAVING A MOVABLE MEMBER

BACKGROUND OF THE INVENTION

1. Field of the Invention

The invention relates to a connector with a movable member for assisting a connection with a mating connector.

2. Description of the Related Art

Japanese Unexamined Patent Publication No. 2001-326024 and Japanese Unexamined Patent Publication No. 2004-30961 disclose a lever-type connector with first and second housings. The connector also has a U-shaped lever with an operable portion and two arms that straddle the first housing. The arms of the lever have cam grooves that engage cam pins on the second housing. The housings are fit lightly together so that the cam pins enter the cam grooves of the lever. The lever then is rotated and the cam action of the cam pins and the cam grooves pull the housings towards a properly connected state.

The rotational axis of the lever may be displaced to one side of the widthwise center to ensure a large rotation stroke of the lever. Some lever-type connectors also have only one arm supported at one side of the housing. A connecting force is skewed if the rotational axis of the lever is displaced from the center of the housing with respect to the width or height directions. As a result, both housings may be inclined from proper connecting postures.

Terminal insertion holes are formed in the rear end surface of the housing and cavities communicate with the terminal insertion holes for accommodating the terminal fittings. The lever is mounted so that the operable portion projects from the rear end surface of the housing.

The terminal fittings may be inserted into the cavities by an automatic machine. The automatic machine may stop temporarily if the front of the terminal fitting contacts a step on the rear end of the housing, thereby deteriorating operation efficiency. More particularly, part of the lever of a lever-type connector may project from the rear end of a housing and may complicate insertion of a terminal fitting by an automatic machine.

The present invention was developed in view of the above problem and an object thereof is to improve the overall operability of the connector.

SUMMARY OF THE INVENTION

The invention relates to a connector with a housing that is connectable with a mating housing. A movable member, such as a rotatable lever or a substantially linearly displaceable slider, is mounted movably to the housing. The movable member includes a cam plate with a cam groove for engaging a cam pin on the mating housing. The movable member can be displaced between an initial position and a connection ending position to displace the cam pin along the cam groove to connect or separate the housing and the mating housing. The movable member and the mating housing engage at a position substantially symmetrical to the engaged position with respect to the widthwise central axis of both housings or with respect to the height central axis of both housings, thereby setting at least two positions to produce forces in directions to connect the housings by the mutual engagement when a connecting operation of the both housings is completed.

The movable member is operated while the cam is engaged with the mating cam and generates forces to connect the housings. However, the connecting forces between the housings may be difficult to balance if the cam plate is positioned asymmetrically. In other words, the connection of the side that has the only cam plate is advanced and the connection of the side opposite the cam plate is delayed. Thus, the housings may be connected in postures inclined with respect to the height axis. Further, the housings may be connected in postures inclined with respect to the width axis if the engaged position of the cam and the mating cam is displaced with respect to the width direction.

The connector also has another engaged position in addition to the engaged position of the cam and the mating cam. Thus, the connecting forces may be balanced with respect to the width direction or height direction of the housings. Accordingly, the postures of the both housings can be corrected to substantially straight connecting postures to allow a smooth connection.

The cam plate may be arranged only on one surface of the housing.

The movable member preferably comprises at least one posture correcting arm arranged rotatably and substantially concentrically with the cam plate on a surface of the housing substantially opposite to the surface that has the cam plate with respect to the height direction of the housing. The movable member preferably includes the posture correcting arm, the cam plate and an operation arm that connects the posture correcting arm and the cam plate. The operation arm is used to rotate the movable member.

The posture correcting arm preferably has at least one hook for engaging a receiving portion in the mating housing and producing forces to pull the housings towards each other during the connecting operation. The hook of the posture correcting arm preferably engages the receiving portion at a position substantially symmetrical to the engaged position of the cam and the mating cam with respect to the heightwise central axis of the housings. Thus, the connecting forces act in a well-balanced manner at the substantially opposite sides of the heightwise central axis of the housings, and the postures of the housings are corrected into substantially straight connecting postures to allow a smooth connection process.

The movable member preferably is arranged so that the engaged position of the cam groove with the cam pin is displaced toward one side from the widthwise central axis of both housings. An operation arm is used to operate the movable member and is provided at an opposite side with respect to the widthwise central axis. The movable member preferably has a pushing surface for pushing the housing on which the movable member is mounted into the mating housing. The housing that has the movable member may be connected faster with the mating housing at the engaged side. However, the pushing surface of the operation arm of the movable member pushes the housing into the mating housing at the widthwise side opposite to the engaged position of the cam and the mating cam. Therefore the postures of the housings are corrected into substantially straight connecting postures.

The housing preferably has a cam-plate accommodating wall. An accommodating space is defined between the cam-plate accommodating wall and an outer surface of the housing for movably accommodating the cam plate. The cam-plate accommodating wall preferably has a cam-pin introducing groove at a position displaced towards a first side from the widthwise central axis of both housings. The cam-plate accommodating wall also has a guide groove at a position displaced towards the opposite side for receiving a lock projection of the mating connector housing. The cam-pin introducing groove and the guide groove extend substantially in connecting directions of the housings.

A locking piece preferably is provided at a position of the cam plate facing the guide groove and can resiliently deform along the thickness direction of the cam plate. The lock projection is guided by the guide groove at the widthwise side opposite to the engaged position. Thus, the connecting posture of the housing can be held in a substantially proper posture. The locking piece engages the lock projection of the mating housing to lock the housings in their connected state when the connecting operation is completed.

The housing preferably has a rear end surface thereof with at least one terminal insertion opening and at least one terminal fitting is inserted into the terminal insertion opening from behind. The movable member is kept in the housing with the rear end surface of the movable member held substantially flush with the rear end of the housing at least at a connection ending position.

It is difficult to insert the terminal fitting into the cavity by an automatic machine if the rear end surface of the lever projects from or is retracted from the rear end surface of the housing. However, the movable member can be kept in the housing with the rear end surface of the movable member held flush with the rear end surface of the housing. Thus, the terminal inserting operation by the automatic machine can be performed smoothly.

The flush disposition of rear end surface of the movable member with the rear end of the housing provides a clear indication that the movable member has reached the connection ending position and the both housings have been connected properly.

The movable member preferably has a side plate arranged to cover at least part of an outer side surface of the housing. The housing has at least one cavity for receiving the terminal fitting inserted through the terminal insertion opening. A retainer is mounted through the outer side surface of the housing where the side plate is arranged. The retainer can be held at a partial locking position where the terminal fitting can be inserted into and withdrawn from the cavity. However, the retainer can be displaced to a full locking position where the properly inserted terminal fitting is retained in the housing. A pushing surface of the retainer projects from the outer side surface of the housing when the retainer is at the partial locking position. The inner side surface of the side plate and/or the pushing surface of the retainer have an escaping recess for avoiding the mutual interference of the movable member and the retainer when the retainer is at the partial locking position.

Interference of the retainer and the side plate can be avoided if the side plate of the movable member is arranged at a distance from the retainer in a connecting direction. However, such an arrangement causes the movable member to project from the rear end surface of the housing. Thus, the rear end surfaces of the lever and the housing cannot be flush with and continuous with each other. However, such a problem is solved by the above-described embodiment and overall operability is improved.

Movement of the movable member preferably is prevented by the contact of the side plate and the retainer in a movement direction unless the retainer is at the full locking position. An inability to move the movable member provides a clear indication that the retainer was left at an intermediate position without reaching the full locking position.

The invention also relates to a connector assembly comprising the above described connector and a mating connector.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

One preferred embodiment of the invention is described with reference to FIGS. 1 to 26. A connector shown in this embodiment preferably is an airbag connector assembly and is provided with at least one pair of male and female connector housings 80, 10 connectable with each other. In the following description, reference is made to FIG. 1 concerning vertical direction VD and sides of the both connector housings 10, 80 to be connected are referred to as front sides concerning forward and backward directions FBD.

Figure 1:
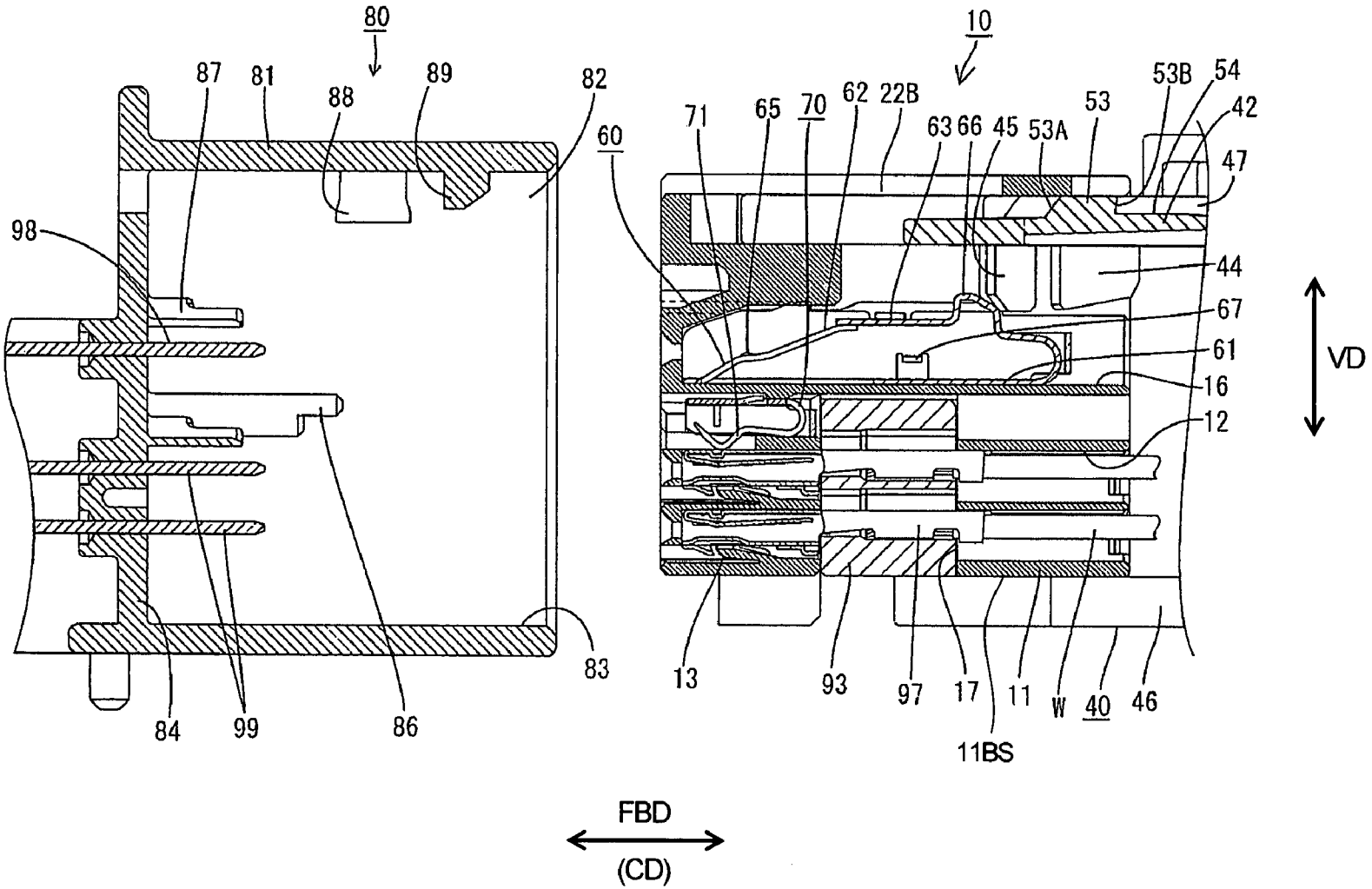
FIG. 1 is a side view in section of both male and female connector housings before being connected in one embodiment.
Figure 17:
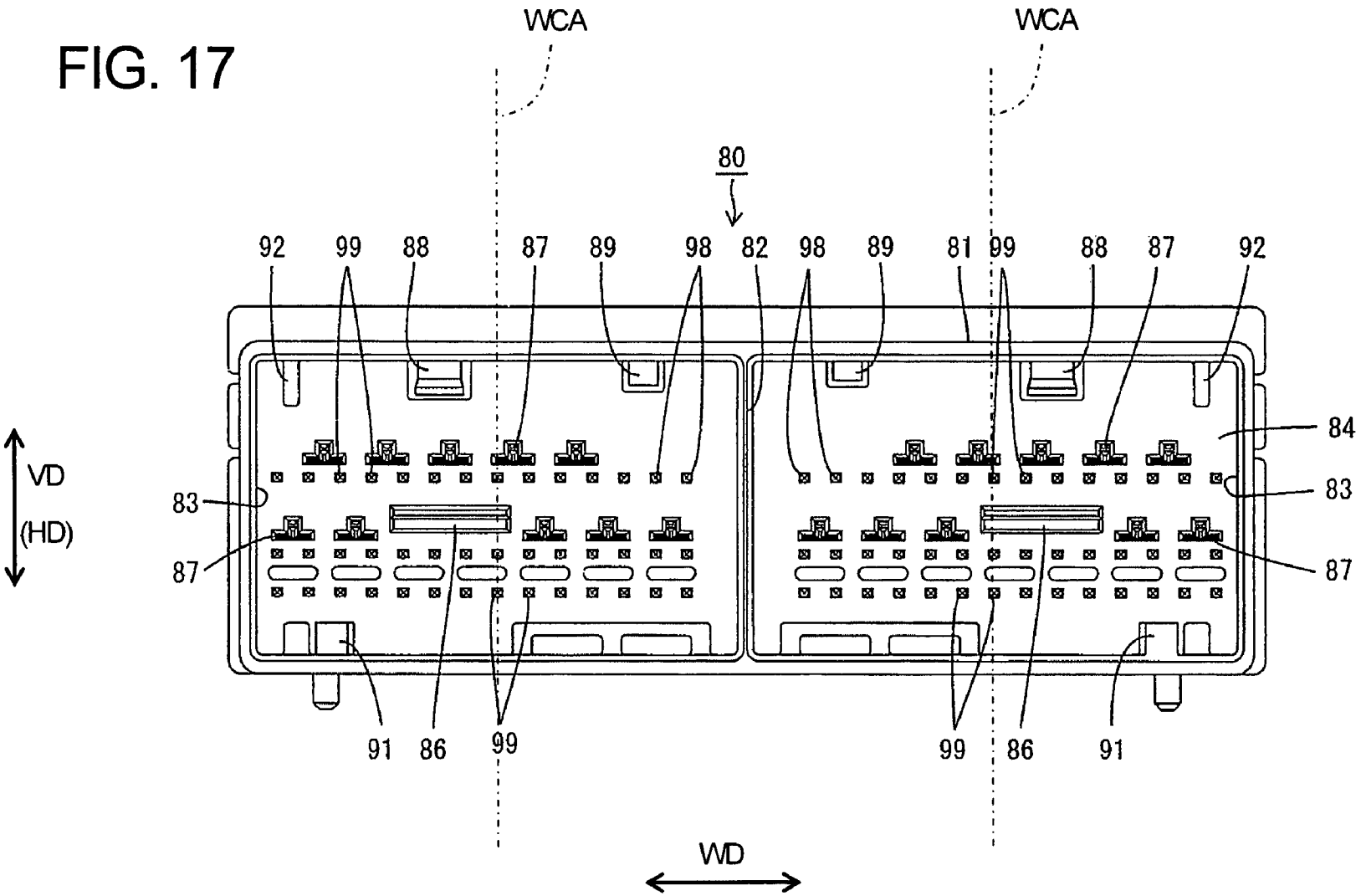
FIG. 17 is a front view of the male housing.

The male housing 80 is made e.g. of a synthetic resin and has a wide rectangular receptacle 81 that opens to the front, as shown in FIGS. 1 and 17. A partition wall 82 extends vertically in the height direction HD substantially along the widthwise center of the inner surface of the receptacle 81, and fitting recesses 83 are formed at the opposite left and right sides of the partition wall 82 for receiving the female housings 10. The fitting recesses 83 are substantially identical and are mirror images of one another that are transversely symmetrical with respect to the partition wall 82.

Tab-shaped male terminal fittings 99 are passed through a back wall 84 of the male housing 80 and project into the receptacle 81. A portion of each male terminal fitting 99 that projects rearward from the back wall 84 is bent down substantially at right angle at an intermediate position and the bottom end thereof is connected electrically with a conductor path of an electric or electronic device, such as an unillustrated printed circuit board, junction box or electric appliance. Left and right protection walls 85 project back at the rear ends of the opposite side walls of the receptacle 81 to protect exposed portions of the male terminal fittings 99 from the outer lateral sides.

Projecting pieces 86 project from the back wall 84 and into the receptacle 81 at positions displaced from the widthwise central axes WCA of the respective fitting recesses 83. The projecting pieces 86 prevent the housings 10, 80 from being assembled erroneously. Short canceling pieces 87 project from the back wall 84 of the male housing 80 and into the receptacle 81 for canceling shorted states of shorting terminals 70 in the female housing 10 as the housings 10, 80 are connected.

Two contact terminals 98 arranged on one side of a group of the male terminal fittings 99 located at an upper stage and above the male terminal fittings 99 in two lower stages. The contact terminals 98 have substantially the same shape as the male terminal fittings 99 at the upper stage and the front ends of the contact terminals 98 substantially align with the front ends of the male terminal fittings 99 in each fitting recess 83. The contact terminals 98 are to be connected electrically with a detecting terminal 60 in the female housing 10 as the housings 10, 80 are connected properly, thereby constructing part of a detecting circuit.

Cam pins 88 project at positions displaced transversely out from the widthwise central axes WCA of the respective fitting recesses 83 and are engageable with cam grooves 41 of levers 40 assembled with the female connector housings 10. Lock projections 89 project at positions displaced towards the partition wall 82 from the widthwise central axes WCA of the respective fitting recesses 83 and are resiliently engageable with locking pieces 42 of the levers 40.

Figure 15:
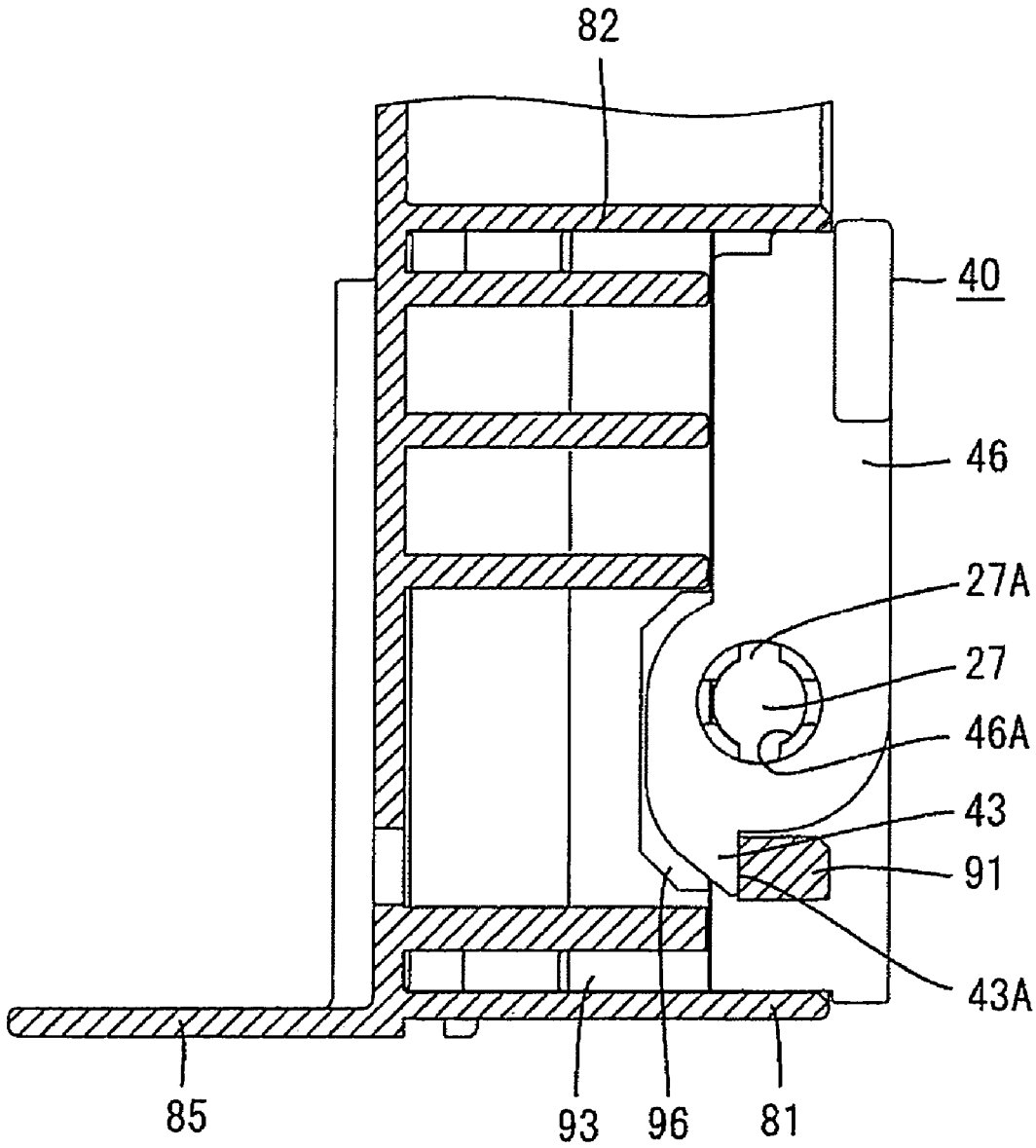
FIG. 15 is a horizontal section of both housings properly connected by the engagement of a hooking portion of the lever with a receiving portion.

Receiving portions 91 project near the front of the bottom wall of the receptacle 81 at positions displaced transversely out from the widthwise central axes WCA of the respective fitting recesses 83, as shown in FIGS. 15 and 17. The receiving portions 91 are engageable with hooks 43 of the levers 40 to correct the postures of the housings 10, 80 during connection. Disengaging projections 92 project from the inner surface of the upper wall of the receptacle 81 at positions displaced transversely out from the widthwise central axes WCA of the respective fitting recesses 83. The disengaging projections 92 are substantially vertical plates that extend in forward and backward directions FBD.

Figure 18:
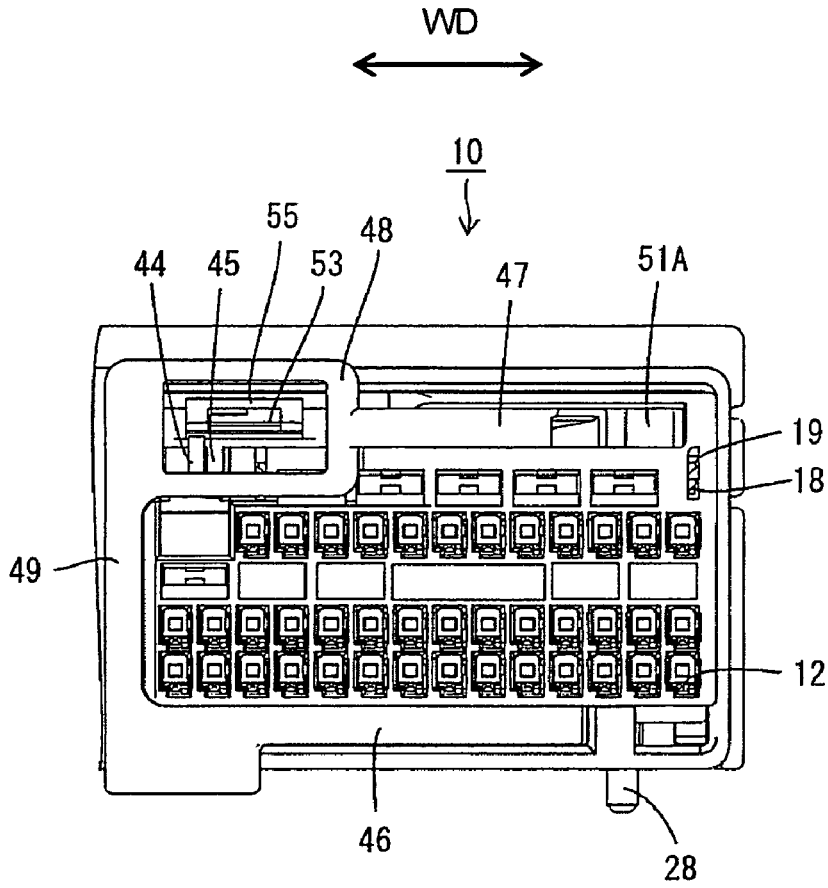
FIG. 18 is a rear view of the female housing.

Two female housings 10 made e.g. of a synthetic resin are prepared in correspondence with the fitting recesses 83. Each female housing 10 has a housing main body 11, a retainer 93 and the lever 40, as shown in FIGS. 1 and 18. The illustrated female housing 10 is accommodated in one fitting recess 83 of the male housing 80 and is substantially transversely symmetrical with respect to the one accommodated in the other fitting recess 83. Thus, the two female housings 10 are substantially mirror images of one another.

Figure 19:
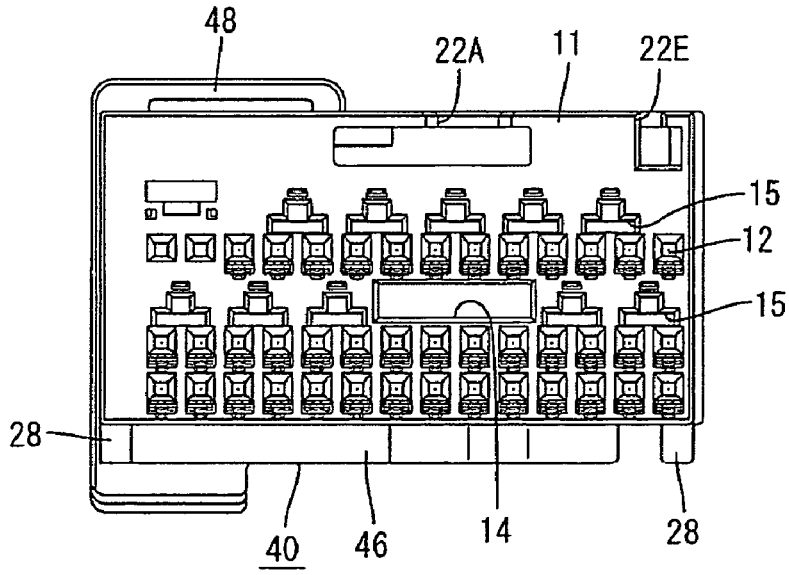
FIG. 19 is a front view of the female housing.
Figure 21:
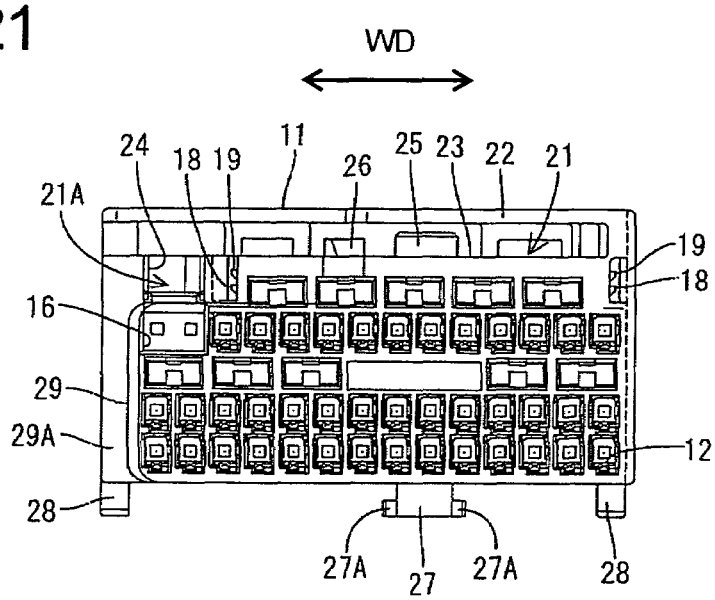
FIG. 21 is a rear view of the housing main body.

The housing main body 11 is substantially block-shaped and cavities 12 extend through the housing main body 11 in forward and backward directions FBD at positions corresponding to the mating male terminal fittings 99, as shown in FIGS. 19 and 21. A female terminal fitting 97 connected with an end of a wire W is inserted into each cavity 12 from behind, and is locked at a proper insertion position by a locking projection 13 that projects at the inner surface of the cavity 12.

A projecting-piece receiving recess 14 is formed in the front surface of the housing main body 11 for receiving the projecting piece 86 of the male connector housing 80 during connection of the housings 10, 80. Insertion of the projecting piece 86 into the projecting-piece receiving recess 14 prevents an upside-down connection of the housings 10, 80.

Figure 2:
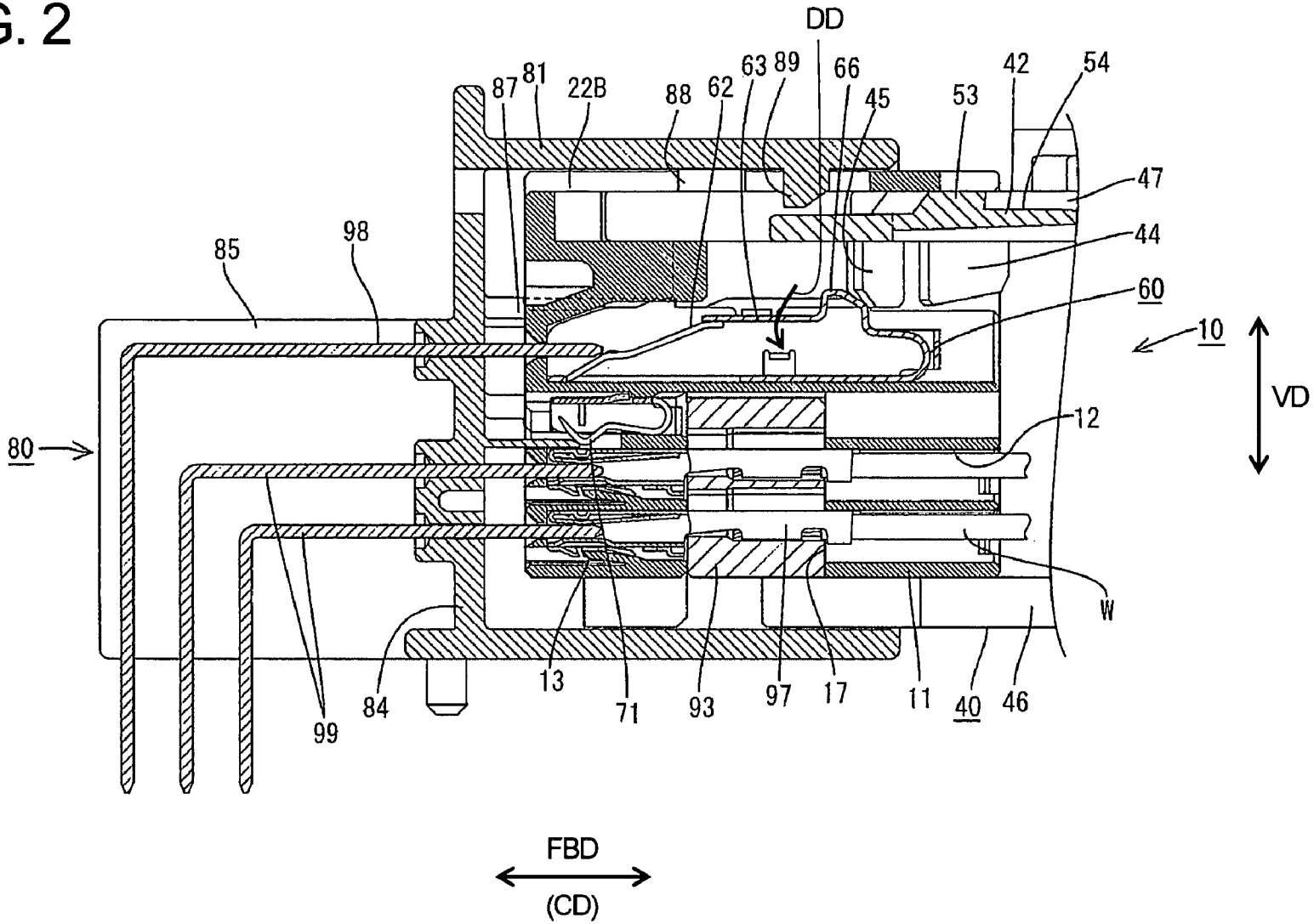
FIG. 2 is a side view in section of the both connector housings immediately before a pre-pressing portion presses a pressable portion.

Shorting-terminal accommodating openings 15 are formed in the front surface of the housing main body 11 and communicate with the cavities 12 located therebelow. The shorting-terminal accommodating openings 15 accommodate shorting terminals 70. Each shorting terminal 70 includes at least two resilient pieces 71 for contacting at least two female terminal fittings 97 arranged substantially side by side in the cavities 12 located therebelow to to short these female terminal fittings 97, as shown in FIG. 1. However, the short canceling pieces 87 of the male housing 80 deform the corresponding resilient pieces 71 of the shorting terminals 70 in a short-canceling direction to cancel the shorted state of pairs of the female terminal fittings 97 during a connecting operation of the housings 10, 80, as shown in FIG. 2.

A detecting-terminal accommodating opening 16 is formed near one lateral side of the housing main body 11. The detecting-terminal accommodating opening 16 is arranged substantially adjacent to and parallel to the upper level cavities 12 for the female terminal fittings 97, and the respective detecting terminals 60 can be inserted therein from behind.

Figure 25:
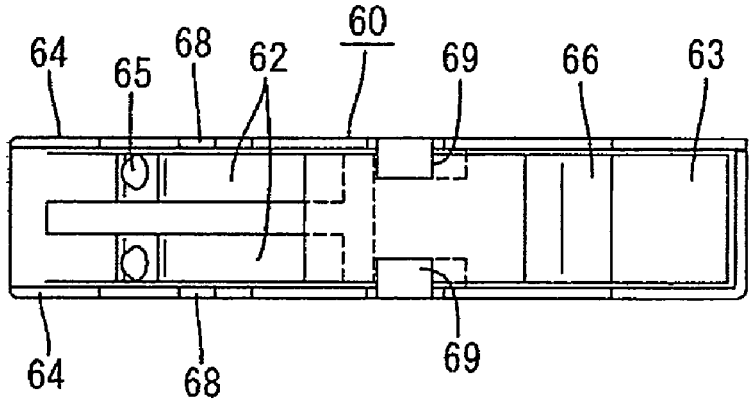
FIG. 25 is a plan view of the detecting terminal and FIG. 26 is a front view thereof.
Figure 26:
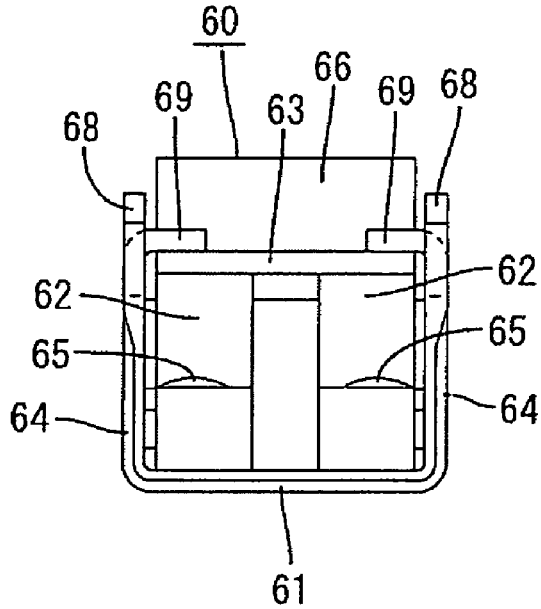

The detecting terminal 60 is formed by bending an electrically conductive metal plate to define a base plate 61 to be arranged substantially along the inner surface of the detecting-terminal accommodating space 16. Two first springs 62 extend obliquely back and up from the front end of the base plate 61. A second spring 63 extends obliquely forward and up from the rear end of the base plate 61, and opposite side walls 64 stand up along opposite side edges of the base plate 61 as shown in FIGS. 1, 25 and 26. The first springs 62 are arranged side by side in the width direction on the base plate 61, and are formed by making a cutout in the base plate 61 to leave a substantially U-shaped piece and bending the lateral projecting pieces. Contacts 65 project at positions near the base ends of the first springs 62 for contacting the contact terminals 98. Accordingly, both first springs 62 connect with the corresponding contact terminals 98, and individually deform to avoid a situation where the first springs 62 are brought out of alignment with the corresponding contact terminals 98. On the other hand, the second spring 63 is formed by folding a rear part of the base plate 61 forward, and the front end of the second spring 63 is arranged to cover the rear ends of both first springs 62 from above.

An upward-projecting pressable portion 66 is formed at an intermediate position of the second spring 63. Specifically, the pressable portion 66 extends substantially vertically at the base end of the second spring 63 and then slants up towards the front. The pressable portion 66 then extends a short distance horizontally from the front of the slant and then vertically down. By rotating the lever 40, the pressing portion 44 and the pre-pressing portion 45 of the lever 40 slide in contact with the pressable portion 60 while making an arcuate movement along a rotational path of the lever 40 to deform the pressing portion 66 down. As the pressable portion 66 is displaced, the first springs 62 also are deformed down in the deforming direction.

Left and right excessive deformation preventing pieces 67 are formed by making cuts in the opposite side walls 64 and bending the cut portions in to prevent excessive deformation of the second spring 63. Left and right lock projections 68 are formed at the upper ends of the opposite side walls 64 and are engageable with the inner surfaces of the detecting-terminal accommodating portion 16. Left and right spring pressing pieces 69 are bent in at the upper ends of the opposite side walls 64 for pressing the opposite side edges of the second spring 63 from above. The second spring 63 is pressed while being loaded beforehand to press both spring pressing pieces 69 up. Therefore it is not necessary to adjust a spring reaction force.

Figure 11:
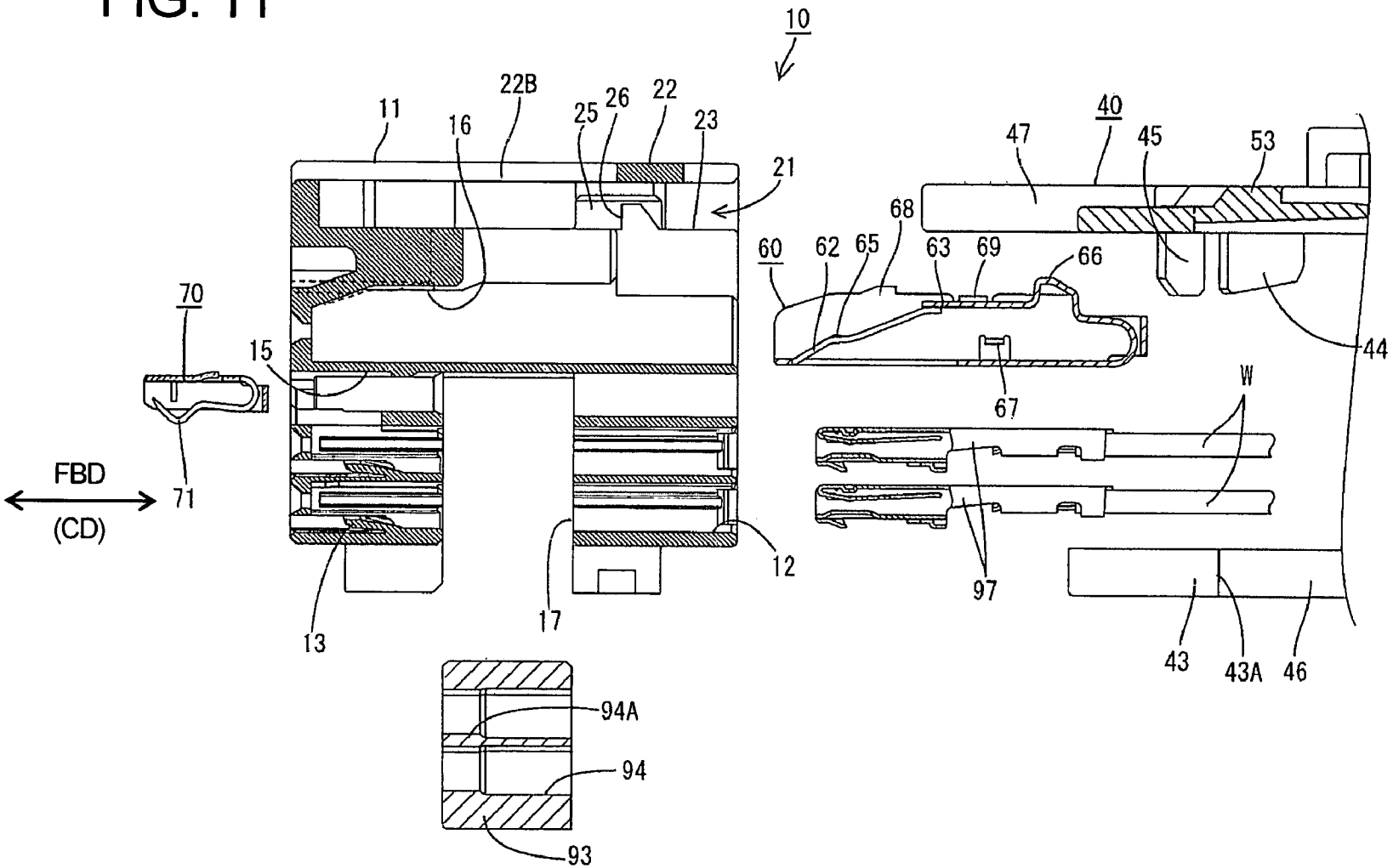
FIG. 11 is an exploded side view in section of the female housing.

As shown in FIG. 11, the housing main body 11 is formed with a retainer mount hole 17 extending over the bottom surface and the opposite side surfaces of the housing main body 11. The retainer mount hole 17 has a depth to cross and communicate with the cavities 12 at the three stages. Partial locking projections 18 and full locking projections 19 are formed one above the other on the opposite side surfaces at an upper part of the retainer mount hole 17 in the housing main body 11, as shown in FIG. 21, for holding the retainer 93 at a partial locking position and a full locking position.

Figure 23:
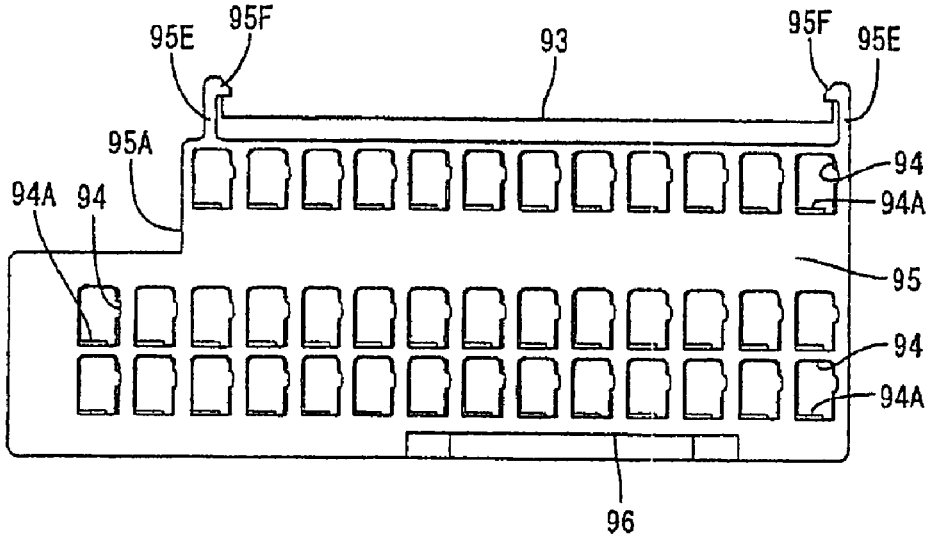
FIG. 23 is a rear view of the retainer.

As shown in FIG. 23, the retainer 93 includes a main frame 95 with windows 94 that communicate with the cavities 12. Latching projections 94A are formed on the inner surfaces of the windows 94 for latching the female terminal fittings 97. A step 95A is formed by cutting off at least one of the four corners of the main frame 95. The surrounding wall of the detecting-terminal accommodating space 16 is fit at the inner side of the step 95A. Left and right resiliently deformable locking arms 95E project up at the opposite lateral ends excluding the step 95A of the main frame 95 and a locking claw 95F projects in at the leading end of each locking arm 95E.

Figure 22:
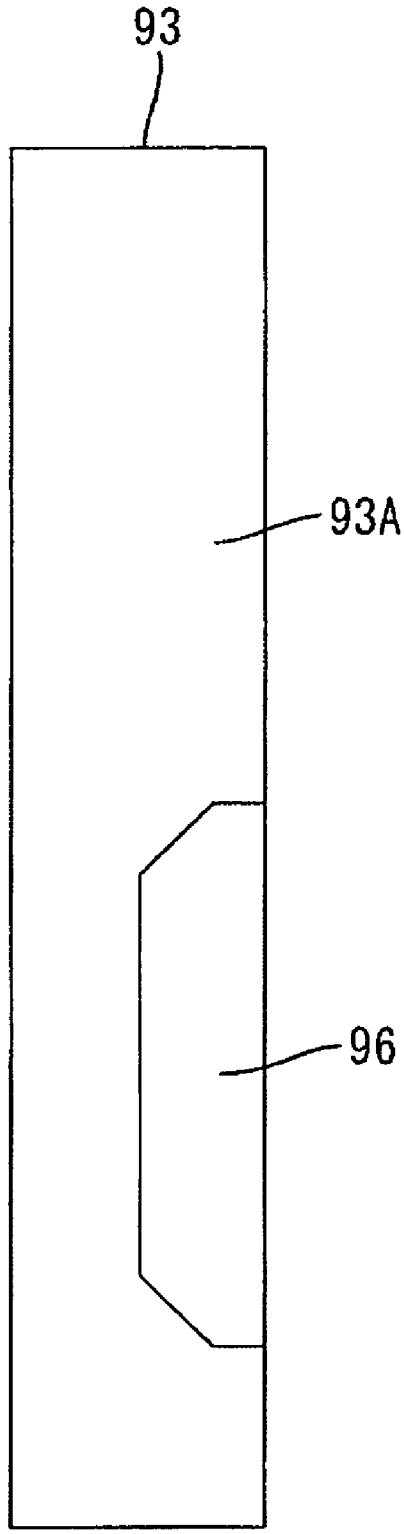
FIG. 22 is a bottom view of a retainer.

The retainer 93 is movable between the partial and full locking positions in the retainer mount hole 17. More particularly, the bottom of the retainer projects from the bottom surface of the housing main body 11 and the locking claws 95F of the locking arms 95E engage the partial locking projections 18 when the retainer 93 is at the partial locking position. On the other hand, the bottom of the retainer 93 is substantially flush with the bottom surface of the housing main body 11 and the locking claws 95F of the locking arms 95E engage the full locking projections 19 when the retainer 93 is pressed deeper to the full locking position. The latching projections 94A are at lateral sides of the cavities 12 when the retainer 93 is at the partial locking position to permit insertion and withdrawal of the female terminal fittings 97. However, the latching projections 94A enter the cavities 12 and cooperate with the locks 13 to retain the properly inserted female terminal fittings 97 in the cavities 12 when the retainer 93 is at the full locking position. Further, as shown in FIGS. 15 and 22, an escaping recess 96 is formed in the bottom press-in surface 93A of the retainer 93 for avoiding interference with a posture correcting arm 46 of the lever 40. A bottom part of the posture correcting arm 46 fits in the escaping recess 96 when the retainer 93 at the partial locking position.

As shown in FIG. 21, a rearwardly open accommodating space 21 is formed at an upper part of the housing main body 11 for accommodating the lever 40. The accommodating space 21 is defined between a thin covering wall 22 located at the outermost position and a lever mounting surface 23 opposed thereto. The lever 40 is mounted by being slid in a substantially horizontal posture into the accommodating space 21 from behind. The detecting-terminal accommodating portion 16 communicates with the accommodating space 21 via a through hole 24 penetrating the lever mounting surface 23.

The escaping recess 96 is formed to conform to the shape of the lateral edge of the posture correcting arm 46. When an attempt is made to rotate the lever 40, the posture correcting arm 46 contacts the inner surface of the escaping recess 96 to prevent any further rotation of the lever 40. The posture correcting arm 46 contacts the inner surface of the escaping recess 96 to prevent rotation of the lever 40 when the bottom surface of the retainer 93 projects from the bottom surface of the housing main body 11, i.e. when the retainer 93 is not at the full locking position.

A substantially cylindrical supporting shaft 25 projects from the lever mounting surface 23 for rotatably supporting the lever 40. A cam plate 47 of the lever 40 moves over the supporting shaft 25 and resiliently deforms the covering wall 22 in the process of mounting the lever 40. Therefore, the supporting shaft 25 is fit into a bearing 47A of the cam plate 47 to retain the lever 40 in the accommodating space 21 when the lever 40 reaches a proper mount position. The supporting shaft 25 is displaced from the widthwise central axis of the housing main body 11 and a central axis of the housing main body 11 with respect to forward and backward directions FBD. A cam-plate engaging portion 26 projects at a position adjacent to the supporting shaft 25 on the lever mounting surface 23, and is engageable with an engaging recess 47B in the cam plate 47 to hold the lever 40 at a connection starting position CSP and a connection ending position CEP.

A supporting shaft 27 projects from the bottom surface 11 BS of the housing main body 11 on the same vertical axis as the supporting shaft 25. The supporting shaft 27 engages a bearing 46A of the posture correcting arm 46 of the lever 40 and cooperates with the supporting shaft to support the lever 40 at two positions. Retaining projections 27A project in substantially opposite directions at the leading end of the supporting shaft 27 so that the posture correcting arm 46 does not come off the supporting shaft 27 during rotation of the lever 40. Left and right adjusting projections 28 are formed at opposite widthwise ends of the bottom surface 11 BS of the housing main body 11 at a sides of the retainer mount hole 17 substantially opposite to the supporting shaft 27 with respect to forward and backward directions FBD. The adjusting projections 28 project substantially the same distance as the supporting shaft 27 so that the leading ends thereof align with the leading end of the supporting shaft 27 to prevent the female housing 10 from being connected while leaning forward in the process of connecting the housings 10, 80.

Figure 20:
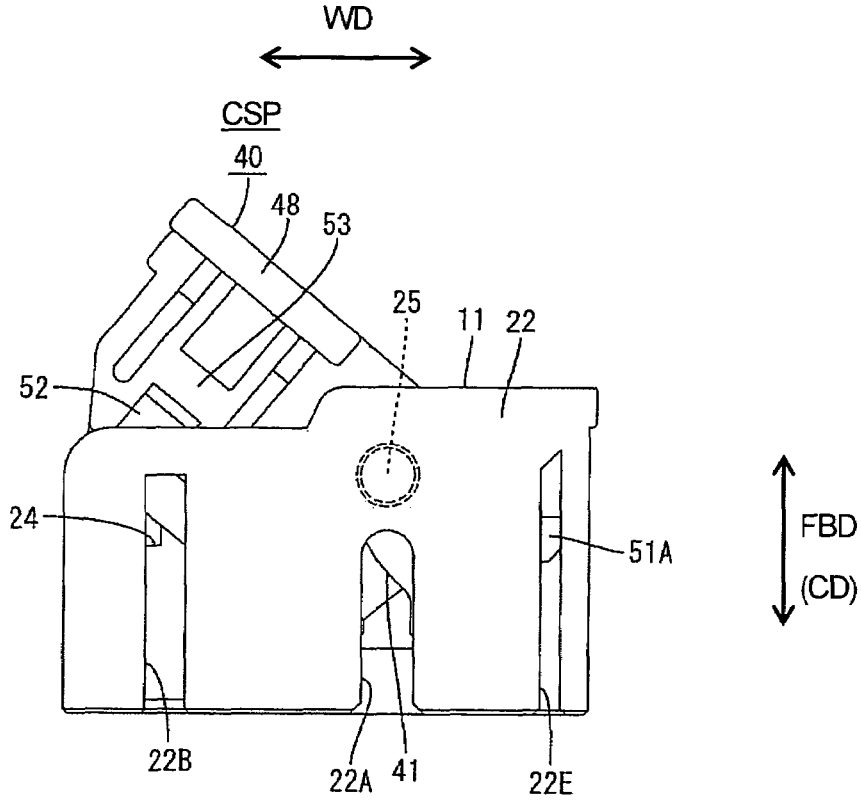
FIG. 20 is a plan view of the female housing when the lever is at a connection starting position.

As shown in FIG. 20, a cam-pin introducing groove 22A is formed in the covering wall 22 immediately before the supporting shaft 25 with respect to forward and backward directions FBD. The cam-pin introducing groove 22A extends in forward and backward directions FBD and opens at the front end for receiving a cam pin 88 of the male housing 80. The cam pin 88 is introduced while being held in sliding contact with the lateral edges of the cam-pin introducing groove 22A. A guide groove 22B is formed in the covering wall 22 at a position displaced toward a side opposite to the cam-pin introducing groove 22A. The guide groove 22B extends in forward and backward directions FBD and opens at the front end for receiving the lock projection 89 of the male housing 80. The lock projection 89 is introduced while being held in sliding contact with the opposite lateral edges of the guide groove 22B. Further, a guiding groove 22E is formed in the covering wall 22 for receiving the disengaging projection 92 of the male housing 80 while being held in sliding contact substantially in parallel with the guide grooves 22B and the cam-pin introducing groove 22A at a side opposite to the guide groove 22B.

Figure 7:
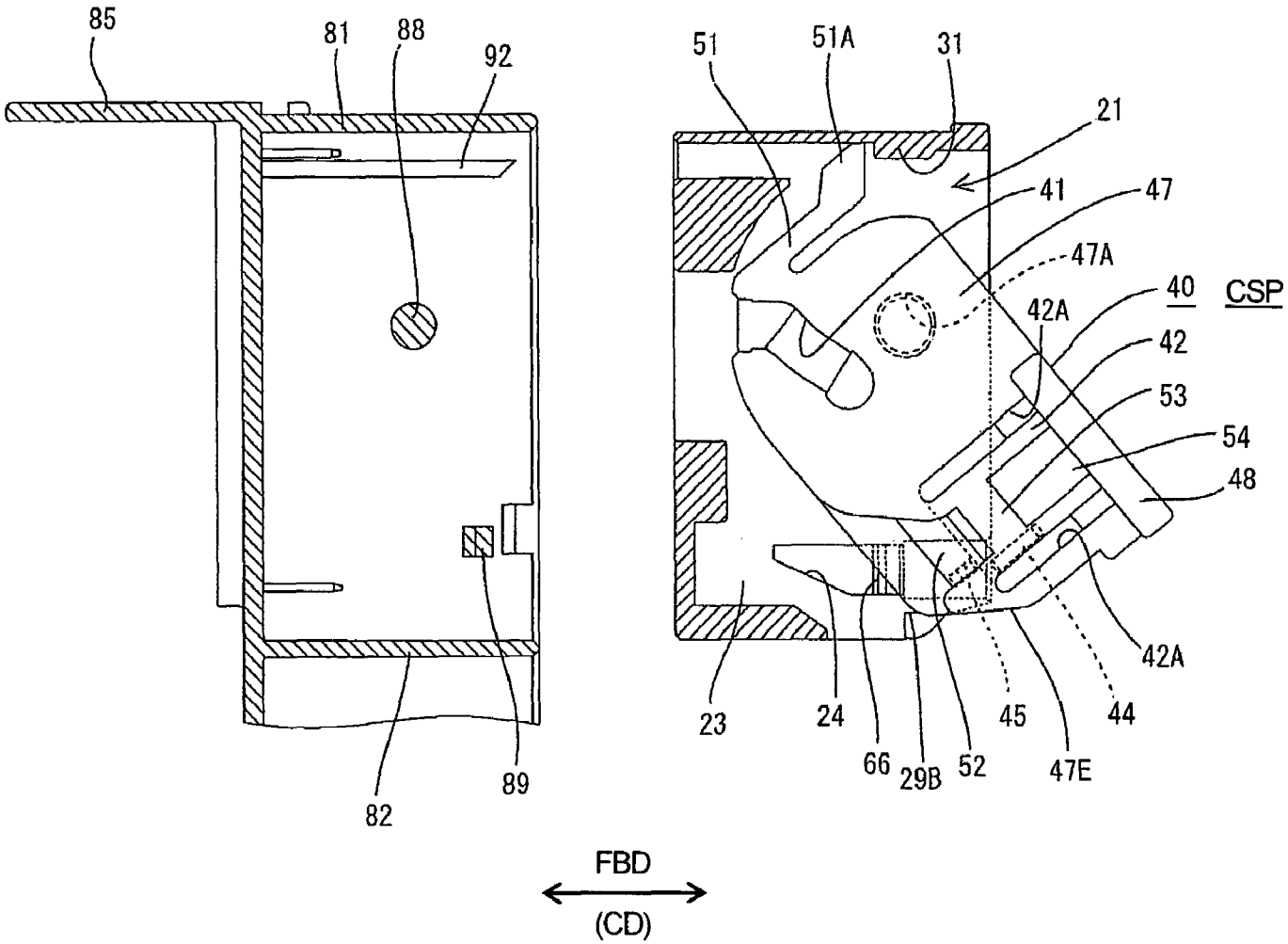
FIG. 7 is a horizontal section of both housings before connection.

The lever mounting surface 23 and the covering wall 22 are cut to expose part of one side of the accommodating space 21 at the rear of the housing main body 11. A protecting-portion accommodating space 21A is defined in an exposed part of the accommodating space 21A and accommodates a rectangular frame-shaped protecting portion 48 of the lever 40. A step 29 is formed in one side surface of the housing main body 11, as shown in FIG. 21, and a stepped recess 29B is defined in an area before the step 29, as shown in FIG. 7. The stepped recess 29B is slightly lower than a rear area and extends substantially vertically to face the accommodating space 21. A contact surface 29A faces forwardly on the step 29 and can be pressed by an operation arm 49 of the lever 40 when the lever 40 is rotated to the connection ending position CEP.

Figure 16:
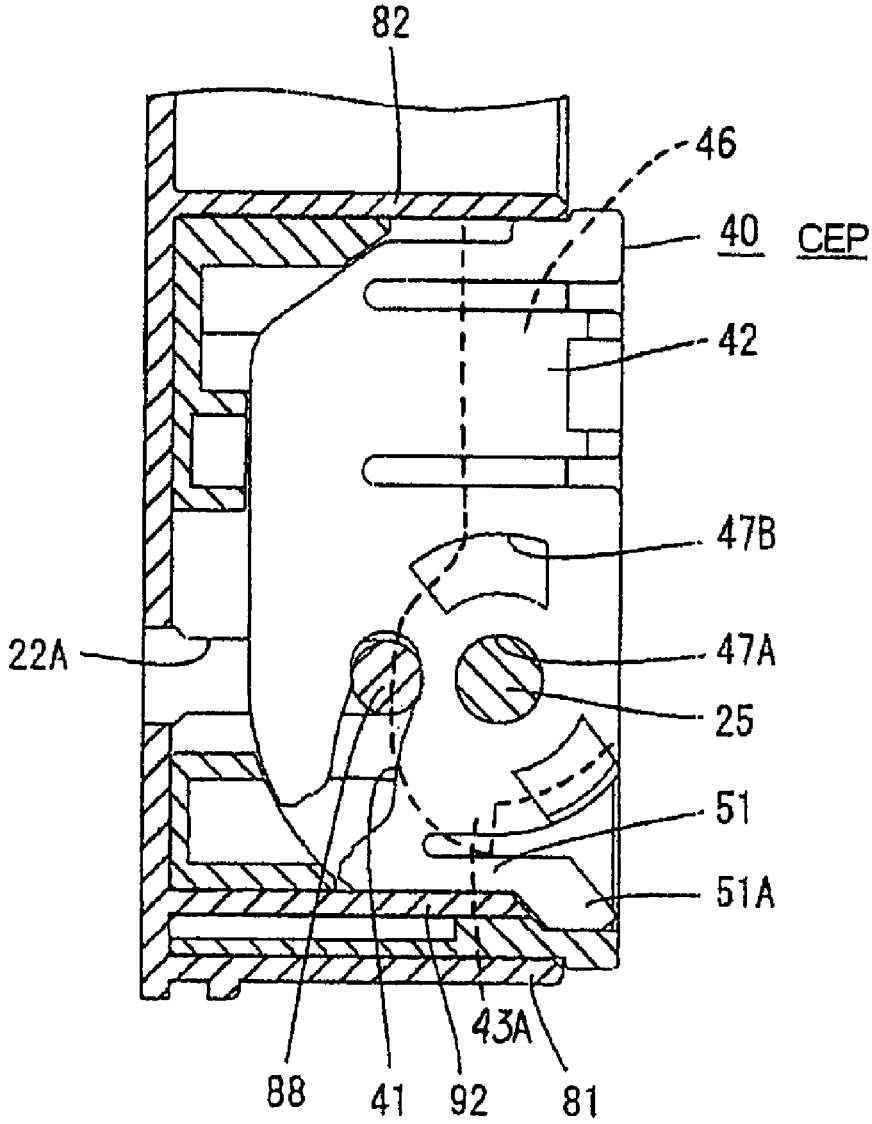
FIG. 16 is a horizontal section of both housings properly connected by the engagement of the cam pin and the cam groove.
Figure 24:
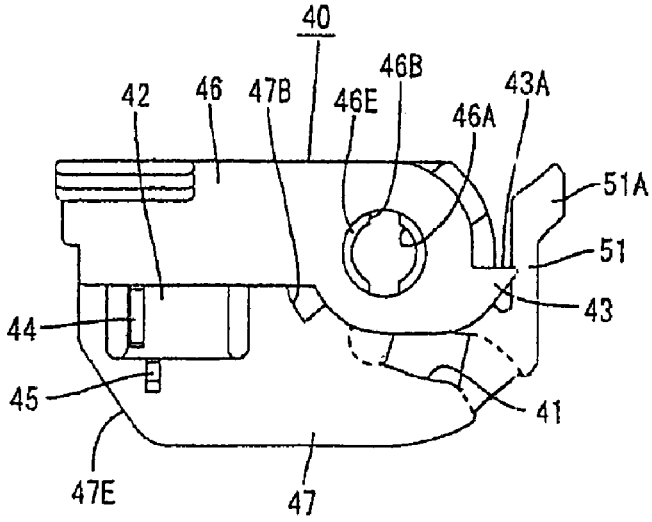
FIG. 24 is a side view of the lever when seen from a posture correcting arm.
Figure 27:
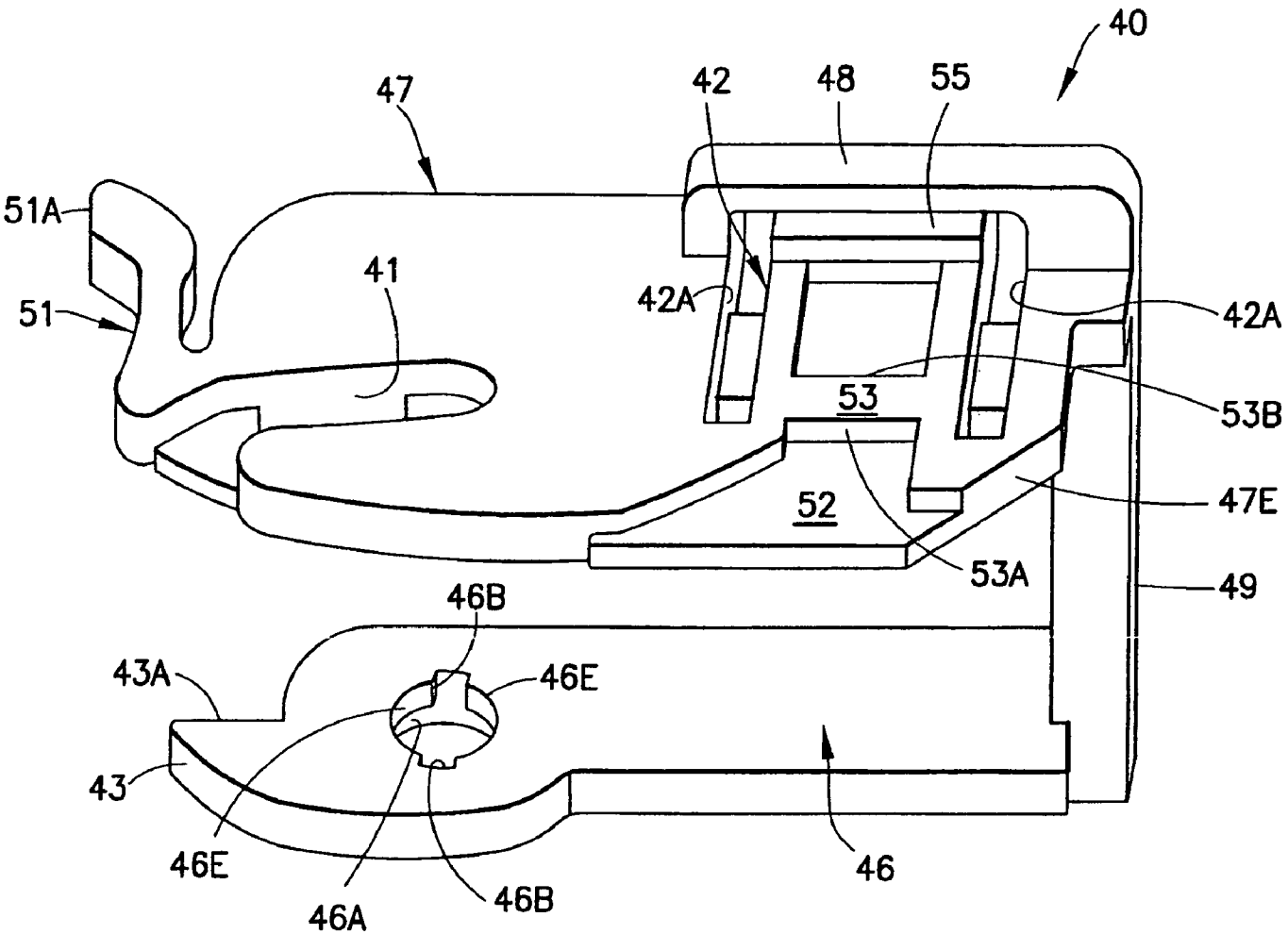
FIG. 27 is a perspective view of the lever.

As described and illustrated above, the fitting recesses 83 are symmetrical about the partition wall 82 and effectively are mirror images of one another. Similarly, as described above, the female housings 10 also are mirror images of one another that are symmetrical relative to the partition wall 82 when the female housings 10 are in the respective fitting recesses 83. Accordingly, the levers 40 also must be mirror images of one another. FIG. 27 is a top perspective view of the lever 40 that is mountable on the female housing 10 that is insertable in the fitting recess 83 shown in FIGS. 7-10. FIG. 24 is a bottom plan view of the same lever 40. FIG. 16, on the other hand, shows the lever 40 that is mounted on the female housing 10 configured for insertion into the other fitting recess 83. As shown in FIGS. 7 and 27, each lever 40 is comprised of a posture correcting arm 46, a cam plate 47 and an operation arm 49 that couples the ends of the cam plate 47 and the arm 46 so that the lever 40 is substantially U-shaped. A cam groove 41 is formed at a portion of the cam plate 47 distanced from the operation arm 49, and is engageable with the cam pin 88 of the male housing 80. Thus, the housings 10, 80 can be connected and separated by movements of the cam pin 88 along the cam groove 41. It should be noted that a cam groove 41 is not formed in the posture correcting arm 46. The state of the lever 40 shown in FIG. 10 is referred to herein as the connection ending position CEP.

The lower surface of the cam plate 47 is cut at a position near the inner end of the cam groove 41 to form a substantially round bearing 47A, as shown in FIG. 16. An engaging recess 47B is formed near the bearing 47A and defines an arc substantially concentric with the bearing 47A, as shown in FIG. 16. The cam-plate engaging portion 26 slides in contact with the engaging recess 47B to guide the rotation of the lever 40.

Figure 8:
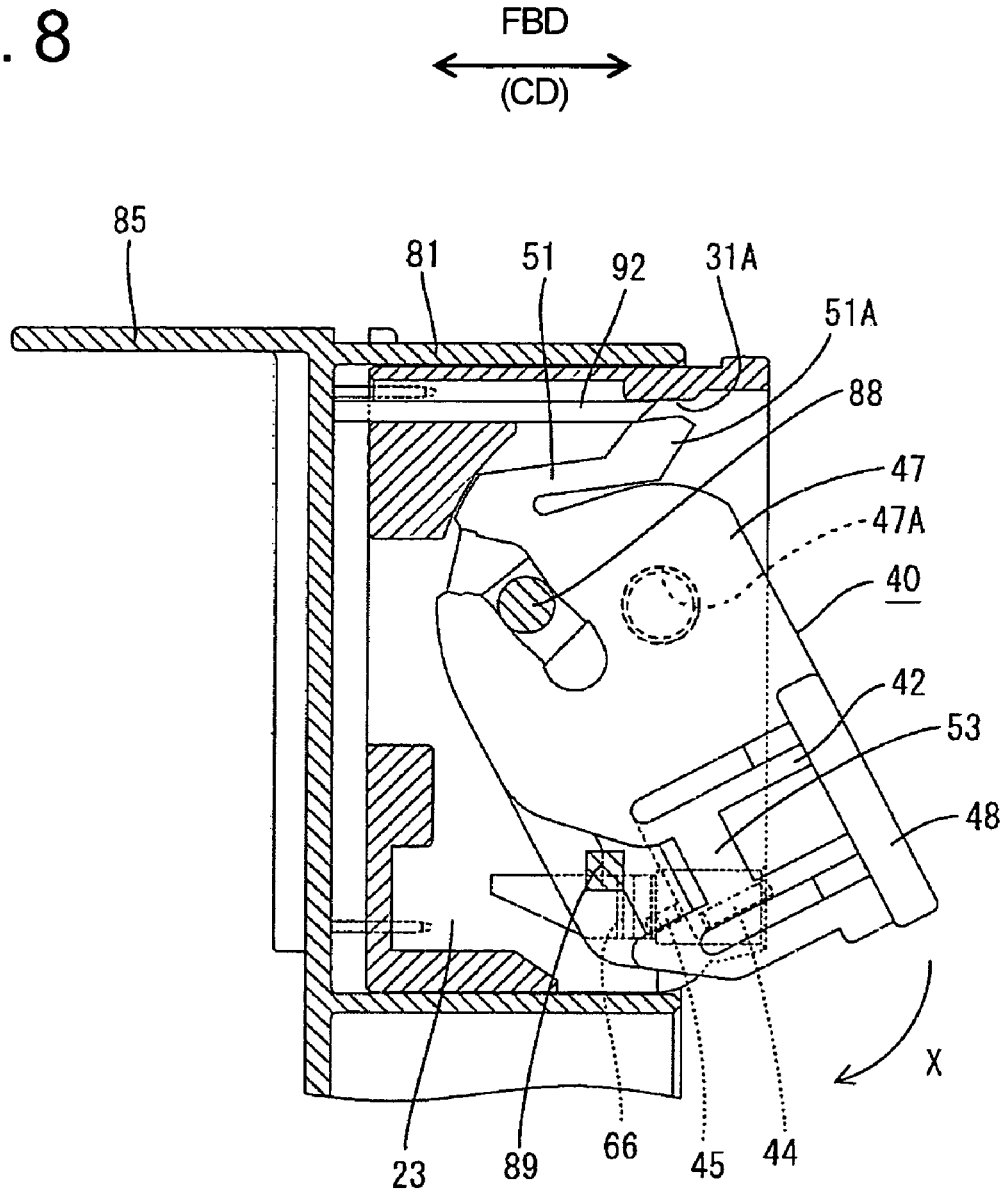
FIG. 8 is a horizontal section of both housings immediately before a connecting operation is started.
Figure 9:
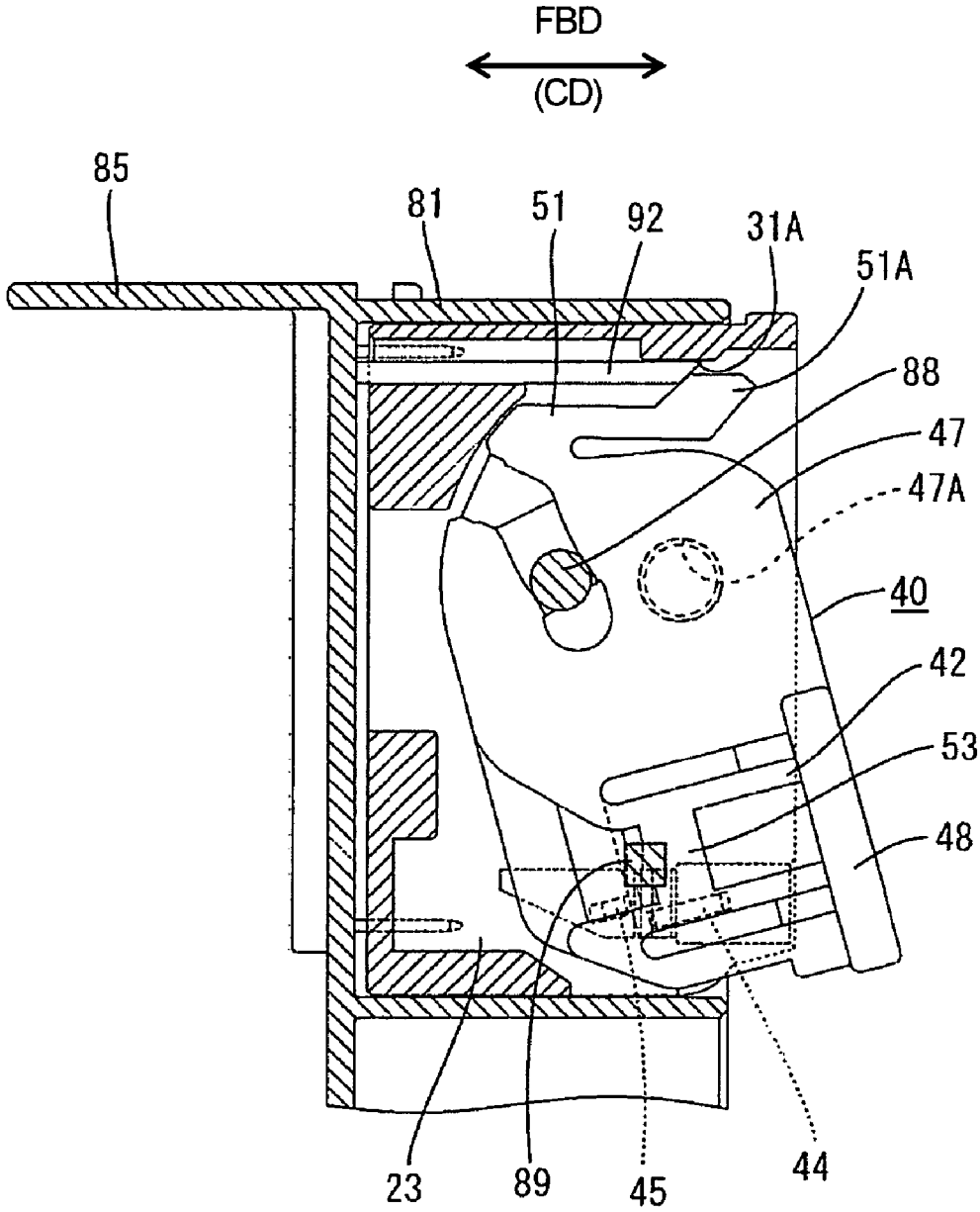
FIG. 9 is horizontal section of both housings during the connecting operation.
Figure 10:
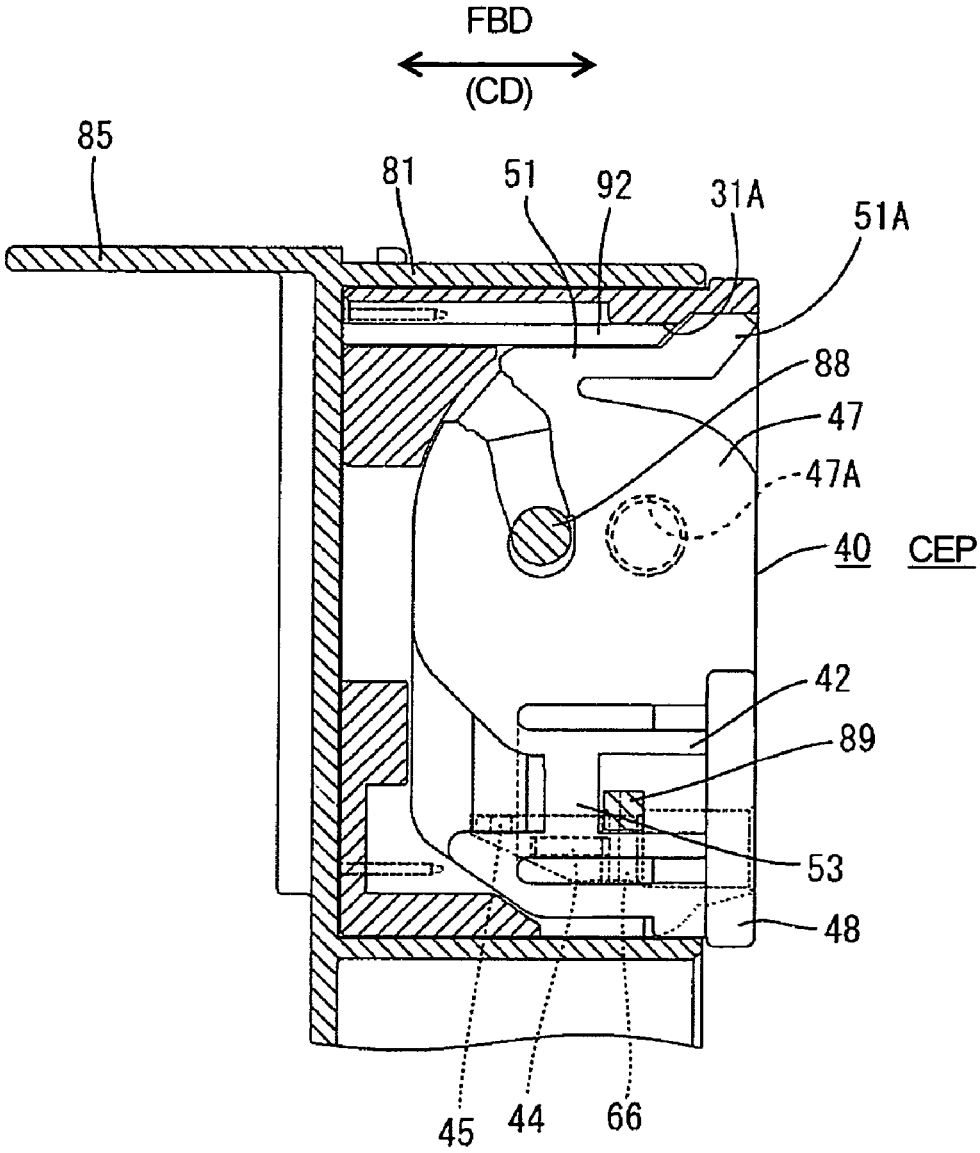
FIG. 10 is a horizontal section of both housings properly connected upon the arrival of the lever at the connection ending position.

A resiliently deformable temporary holding arm 51 is formed at the outer periphery of the cam plate 47 near the entry of the cam groove 41, as shown in FIG. 7 to 10, and extends substantially in forward and backward directions FBD when the lever 40 is at the connection ending position CEP of FIG. 10. A tip projection 51A of the temporary holding arm 51 engages a temporarily receiving portion 31 at a lateral edge of the accommodating space 21 of the housing main body 11 before the housings 10, 80 are connected (see FIG. 10) to prevent rotation of the lever 40. The tip projection 51A is pushed by the disengaging projection 92 of the male housing 80 when a connecting operation of the housings 10, 80 is started, and is deformed resiliently in the unlocking direction so that the lever 40 can rotate.

A resiliently deformable locking piece 42 is formed by two slits 42A that open at the rear end of the cam plate 47 near the operation arm 49 and substantially opposite the cam groove 41 and the bearing 47A, as shown in FIG. 7. Thus, the locking piece 42 can deform up and down about its front end so that the rear end of the locking piece 42 can engage the lock projection 89 of the male housing 80. The cam plate 47 has a slanted edge 47E that limits the forward extent of one of the slits 42A, as shown in FIG. 7.

Figure 4:
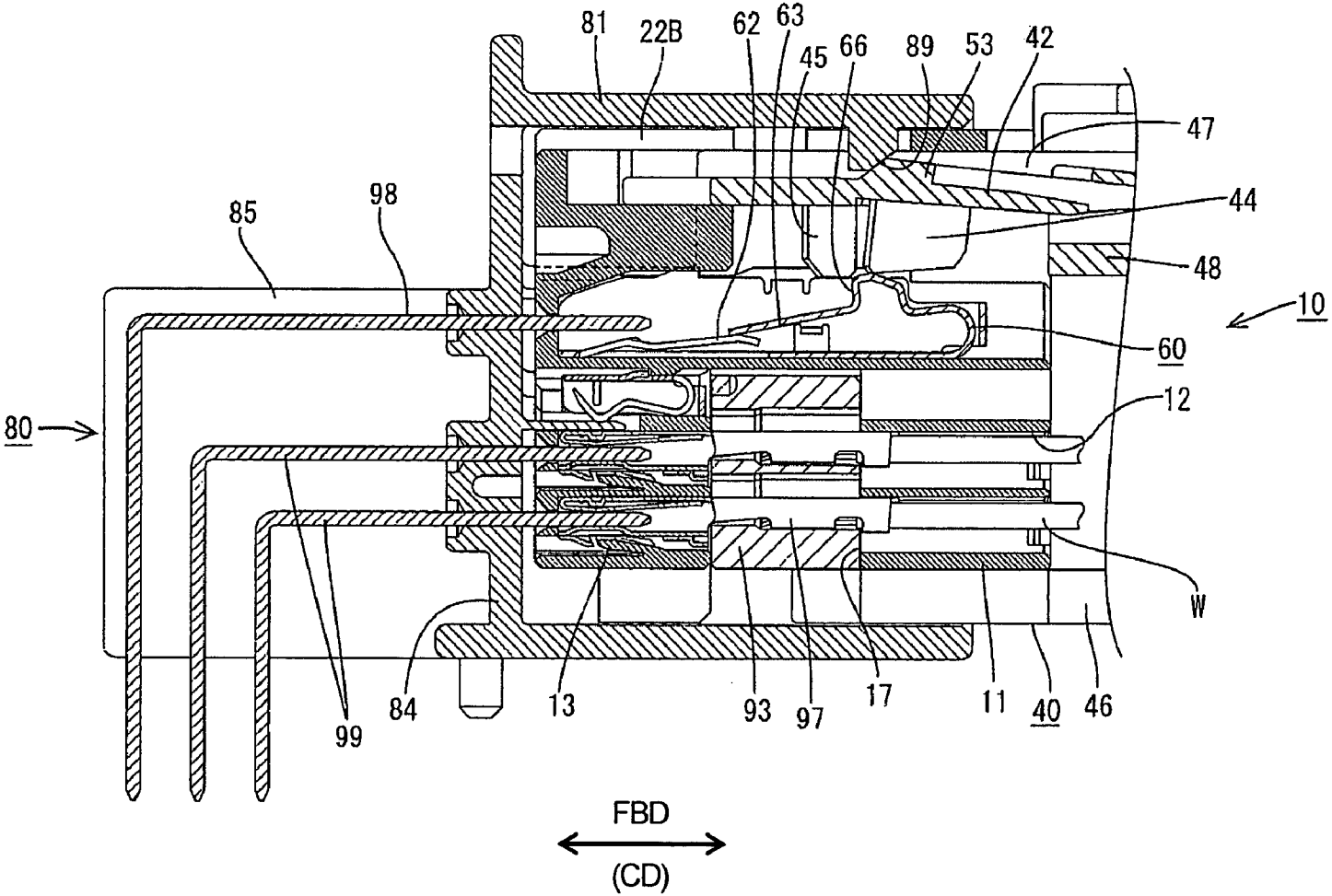
FIG. 4 is a side view in section of both housings showing a state where, instead of the pre-pressing portion, a pressing portion presses the pressable portion.
Figure 5:
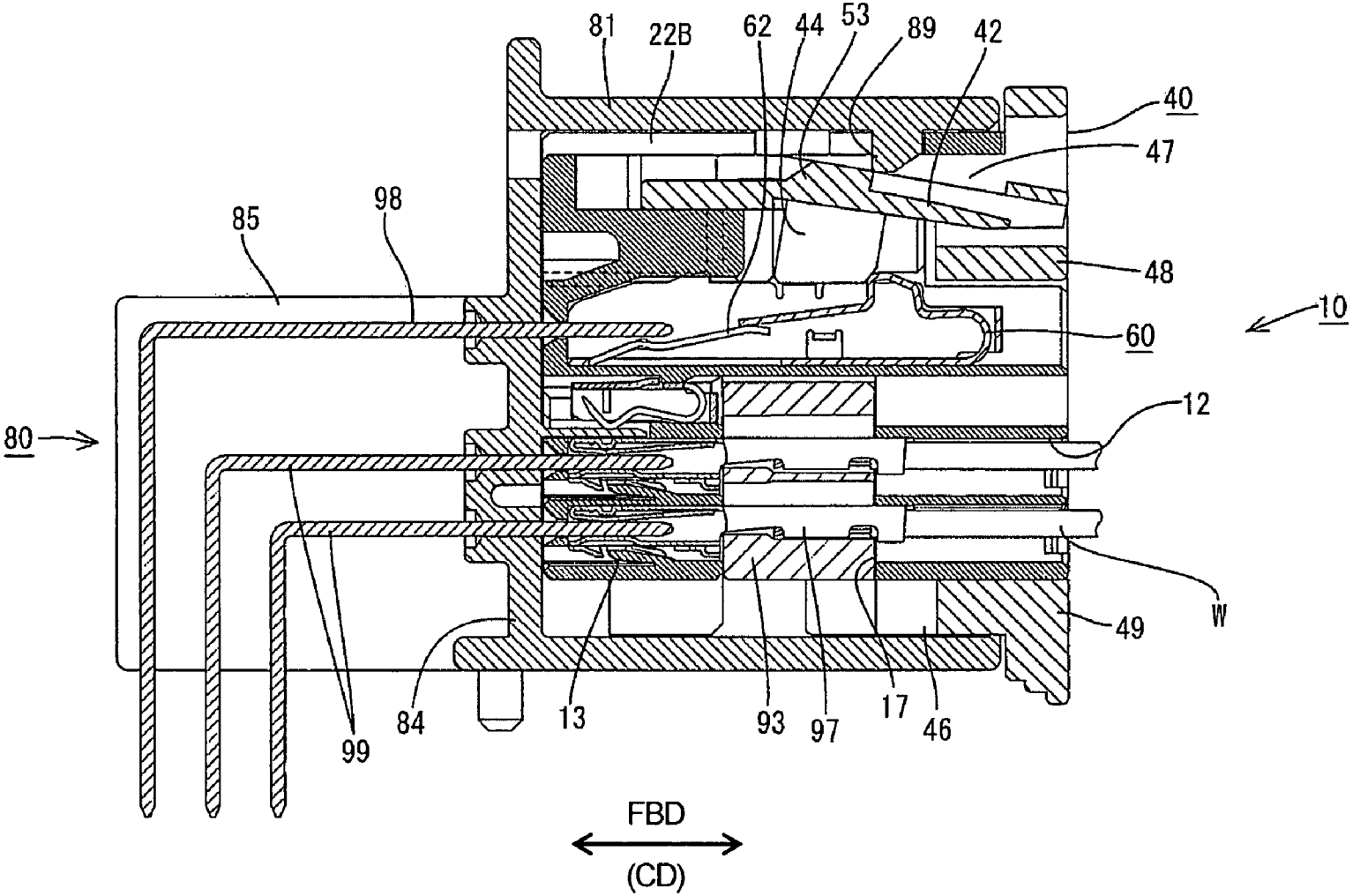
FIG. 5 is a side view in section of the both housings showing immediately before a pressed state by the pressing portion is canceled.

An escaping recess 52 is formed in an area of the upper surface of the cam plate 47 before the locking piece 42 for avoiding interference with the lock projection 89 and to enable rotation of the lever 40, as shown in FIG. 7. A locking projection 53 is formed near the base end of the locking piece 42 and is substantially continuous with the rear end of the escaping recess 52. A slanted guiding surface 53A is formed at the front of the locking projection 53 and slopes up and out towards the back, as shown in FIG. 1. The upper surface of the locking projection 53 is substantially flat and coplanar with the general reference surface of the cam plate 47. A substantially vertical locking surface 53B is formed at the rear of the locking projection 53 and defines a step into a recess 54 behind the locking projection 53, as shown in FIG. 1. The lock projection 89 moves along the guiding surface 53A of the locking projection 53 during rotation of the lever 40 and deforms the locking piece 42 down and in, as shown in FIG. 4. The lock projection 89 slides in contact with the flat surface of the locking projection 53, as shown in FIG. 5, and then fits into the recess 54 when the lever 40 reaches the connection ending position CEP, as shown in FIG. 1. Thus, the lock projection 89 is locked by the locking surface 53B of the locking projection 53.

Figure 14:
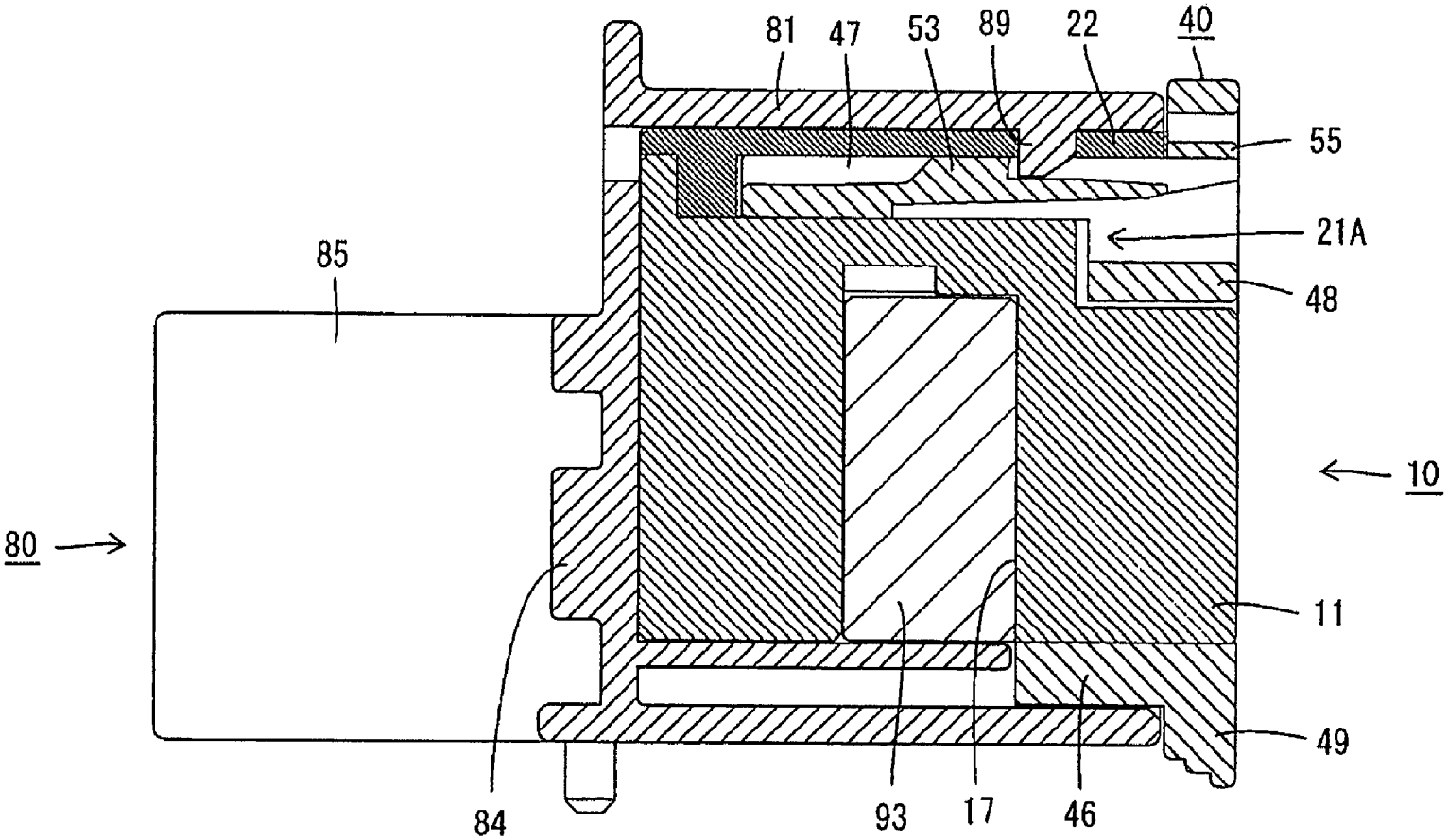
FIG. 14 is a side view in section of both housings properly connected showing a state where a locking piece of the lever is engaged with a lock projection.

A locking-piece operating portion 55 is at a slightly higher position at the rear end of the locking piece 42, as shown in FIGS. 14 and 18, and can be pressed down to disengage the locking piece 42 from the lock projection 89. A substantially rectangular protecting frame 48 is formed at the rear end of the cam plate 47, as shown in FIG. 7 and 18, and surrounds at least part of the periphery of the locking-piece operating portion 55, as shown most clearly in FIG. 18. One side of the protecting portion 48 is joined with the operation arm 49 to bulge vertically out from the rear end of the cam plate 47, as shown in FIG. 18 and is accommodated in the protecting-portion accommodating space 21A of the housing main body 11 when the lever 40 is at the connection ending position CEP, as shown in FIG. 14.

Figure 6:
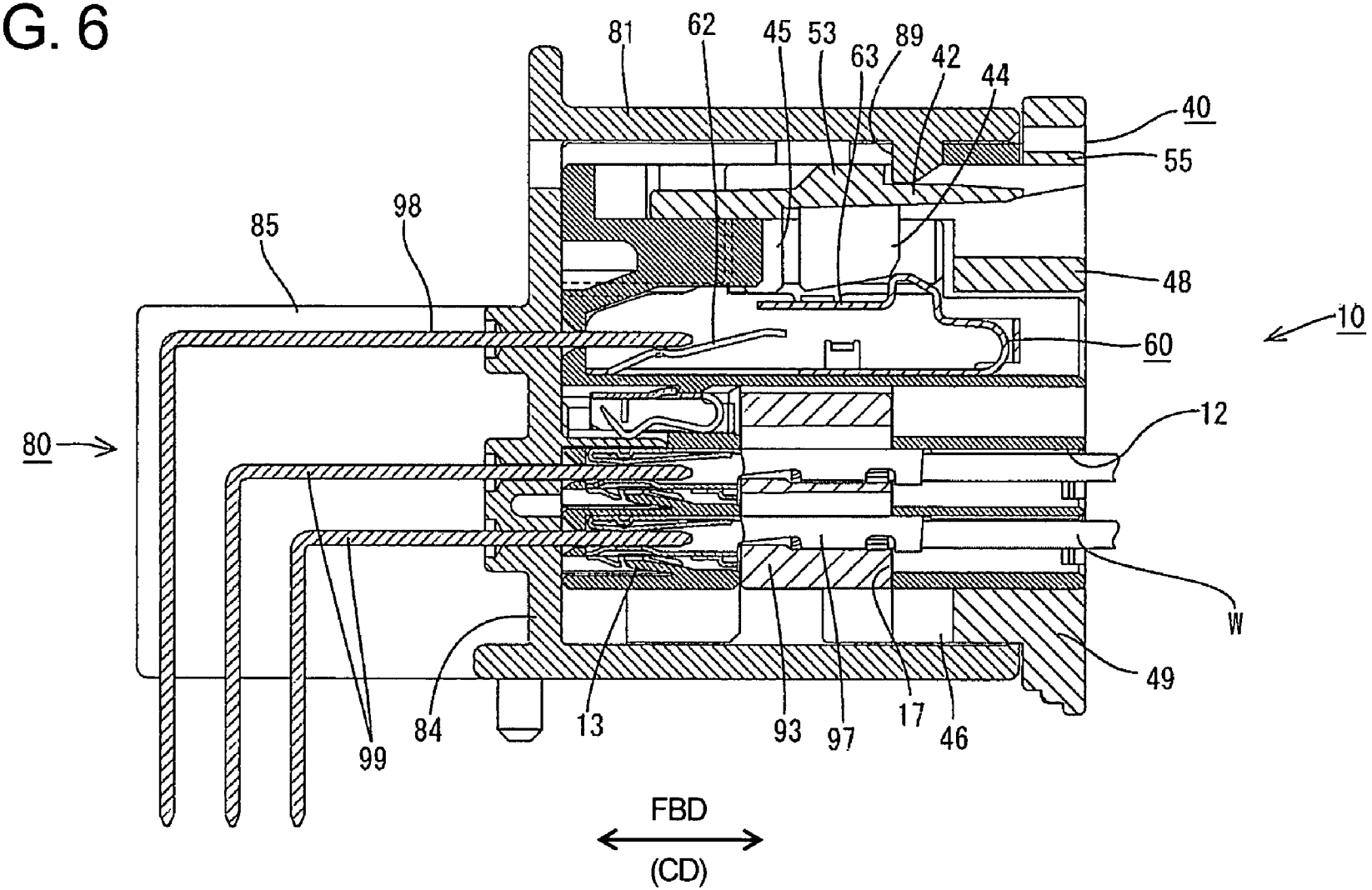
FIG. 6 is a side view in section of both housings where the pressed state of the pressing portion is canceled upon arrival of a lever at a connection ending position to establish contact of contact terminals and a detector.

As shown in FIGS. 1 and 24, a pressing portion 44 projects substantially along one lateral edge of the base end of the locking piece 42 on the lower surface of the cam plate 47. The locking projection 53 engages the lock projection 89 at a rotation position of the lever 40 before the connection ending position CEP and causes the locking piece 42 to deform down and in. As a result, the pressing portion 44 contacts the pressable portion 66 of the second spring 63 of the detecting terminal 60 from behind and deforms the second spring 63 down and in together with the first springs 62. The pressing portion 44 stops pressing the second spring 63 substantially when the lever 40 reaches the connection ending position CEP, as shown in FIG. 6, so that the first and second springs 62 and 63 restore resiliently. The front end of the pressing portion 44 is substantially vertical and the bottom end thereof is sloped up towards the back. The slant of the pressing portion 44 is substantially horizontally held when the locking piece 42 is deformed maximally, as shown in FIG. 5.

Figure 3:
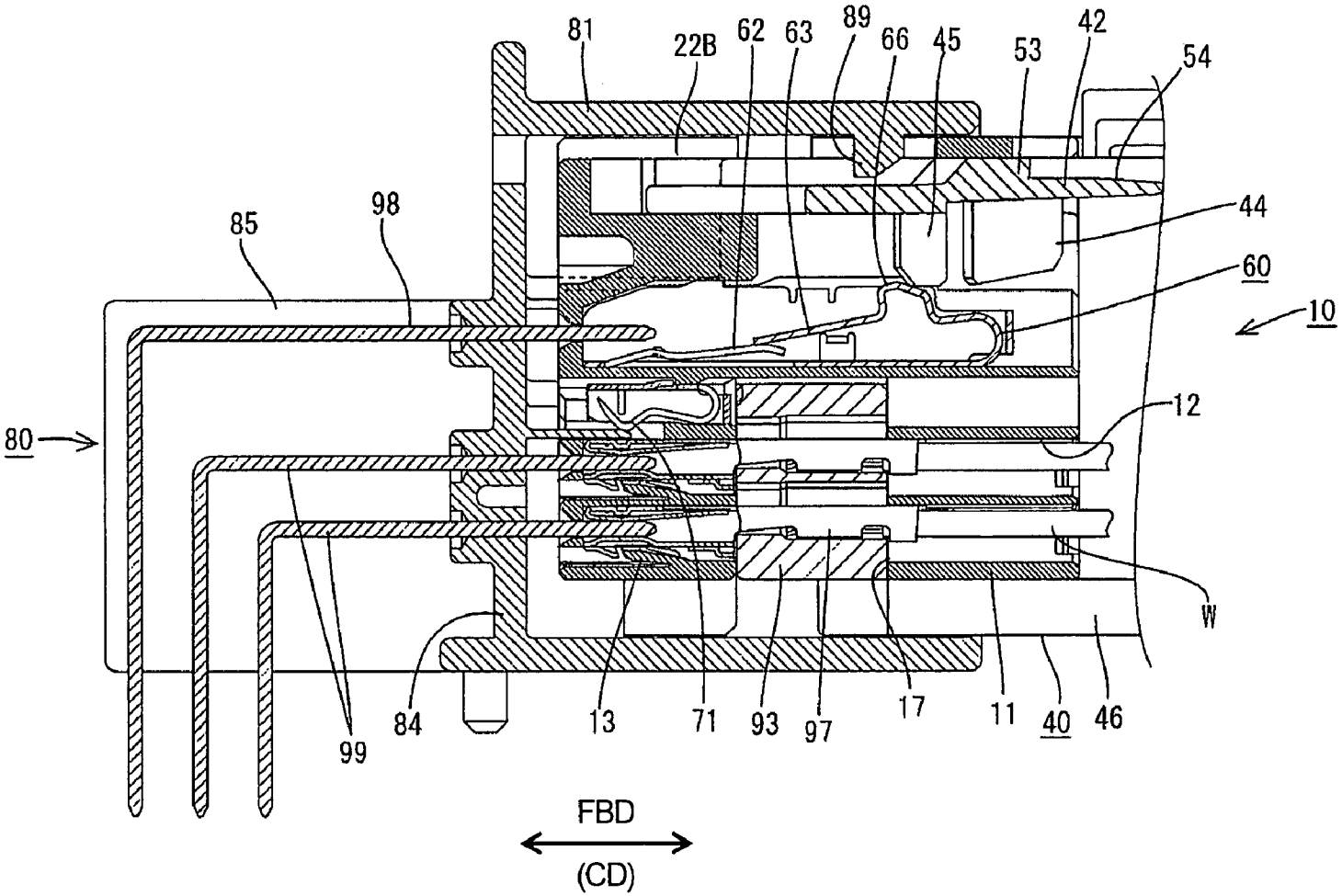
FIG. 3 is a side view in section of the both housings showing a state where the pre-pressing portion presses the pressable portion.

A pre-pressing portion 45 projects on the inner surface of the cam plate 47 at a position before the locking piece 42 and displaced slightly inward in the width direction WD from the pressing portion 44, as shown in FIGS. 1 and 24. The pre-pressing portion 45 extends substantially parallel to the connecting direction CD, as shown in FIG. 24, but is shorter in forward and backward directions FBD than the pressing portion 44, as shown in FIGS. 1 and 24. The pre-pressing portion 45 contacts the pressable portion 66 from behind to deform the first and second springs 62 and 63 before the pressing portion 44 presses the pressable portion 66 of the detecting terminal 60 during the rotation of the lever 40, as shown in FIGS. 2 and 3. The pre-pressing portion 45 moves over the pressable portion 66 as the lever 40 is rotated further, and the pressing portion 44 presses the pressable portion 66 of the second spring 63 when the pre-pressing portion 45 stops pressing the second spring 63, as shown in FIG. 4. A bottom part of the front end of the pre-pressing portion 45 slopes down and in towards the back, and the bottom end thereof is substantially horizontal and flat. The pre-pressing portion 45 is in a range unaffected by the deformation of the locking piece 42 and is distanced from the pressing portion 44. Thus, the rear end of the pre-pressing portion 45 and the front end of the pressing portion 44 will not interfere while the locking piece 42 is deformed.

The contact terminals 98 enter the detecting terminal 60 as the lever 40 is rotated. However, the pre-pressing portion 45 and the pressing portion 44 successively press the first and second springs 62 and 63 to displace the contact portions 65 of the first springs 62 during the rotation of the lever 40, as shown in FIGS. 2 through 4. Thus, the contacts 65 of the first springs 62 do not to touch the contact terminal 98. On the other hand, the pressing portion 44 stops pressing the second spring 63 when the lever 40 reaches the connection ending position CEP, as shown in FIGS. 5 and 6. As a result, the first and second springs 62 and 63 resiliently restore to bring the contacts 65 of the first spring 62 into contact with the contact terminals 98, thereby closing a detecting circuit, as shown most clearly in FIG. 6.

Figure 13:
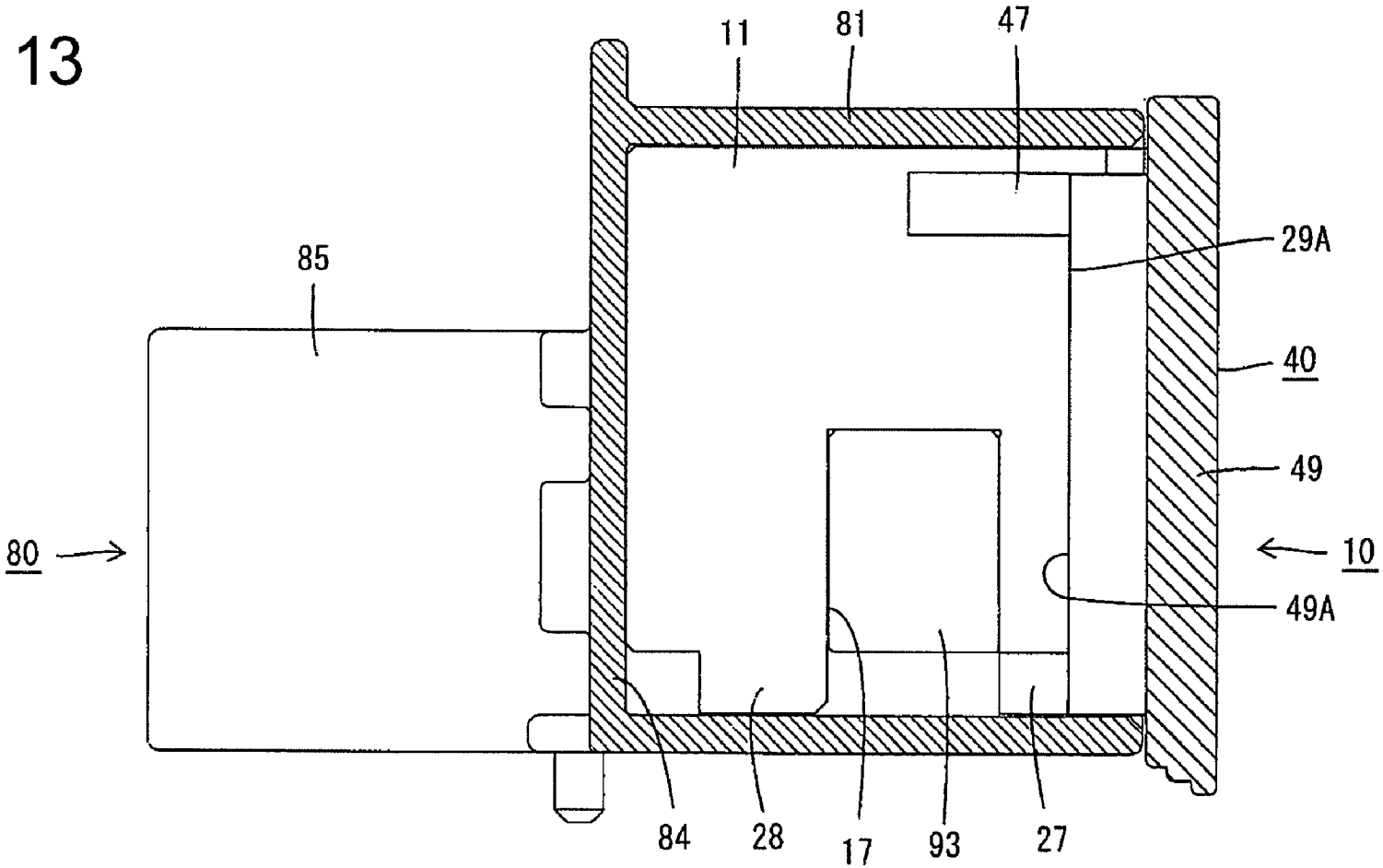
FIG. 13 is a side view in section of both housings properly connected by a pushing surface of the lever pushing a housing main body.

As shown in FIG. 13, the operation arm 49 of the lever 40 is a long plate extending substantially in the height direction HD and substantially normal to the forward and backward directions FBD. The operation arm 49 fits into the stepped recess 29B of the housing main body 11 and a pushing surface 49A at the front end of operation arm 49 is pressed against the contact surface 29A of the housing main body 11 when the lever 40 reaches the connection ending position CEP, as shown in FIG. 13. The pushing surface 49A of the operation arm 49 presses the contact surface 29A forward in a connecting direction CD to prevent the housings 10, 80 from being connected in inclined postures.

Figure 12:
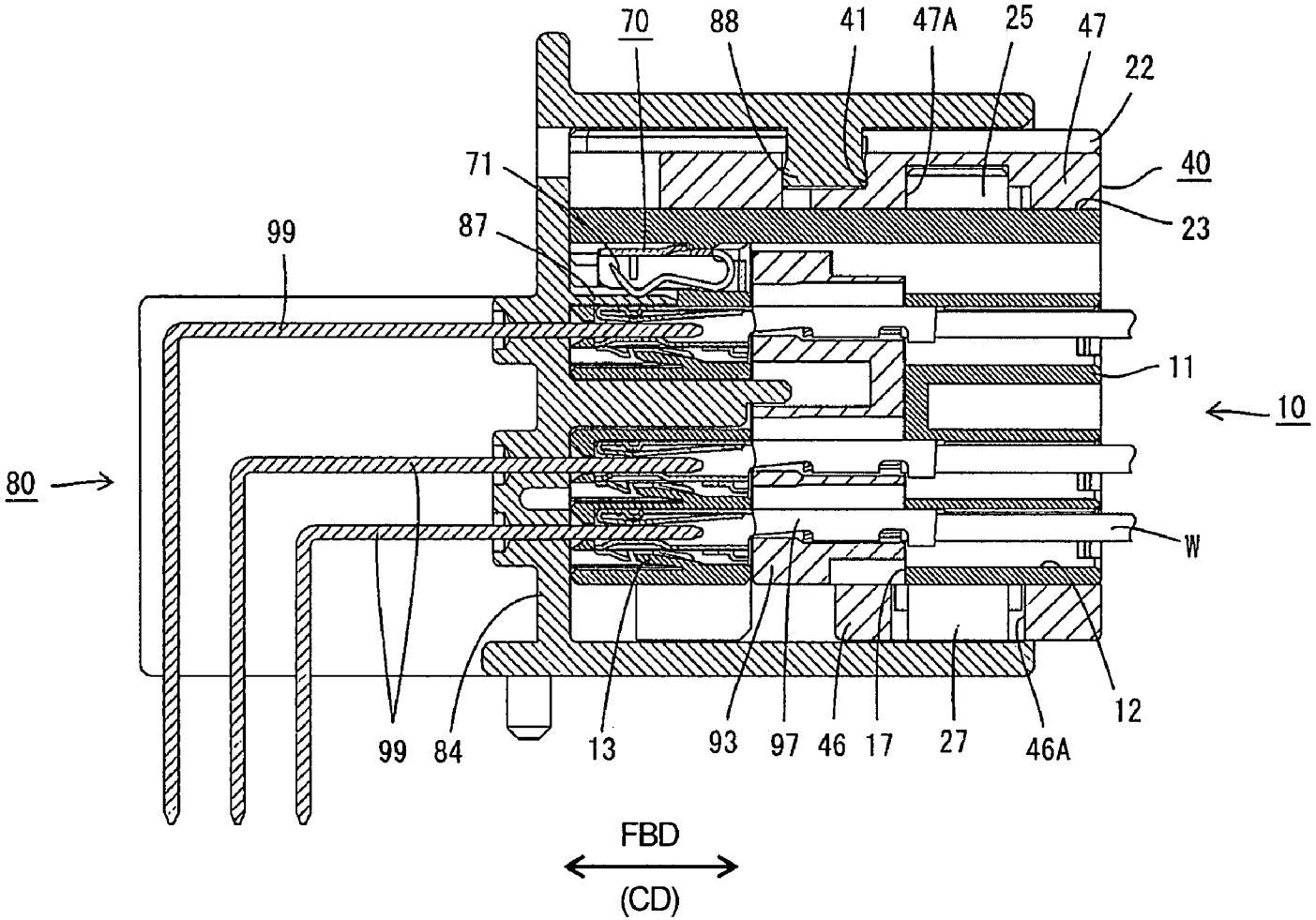
FIG. 12 is a side view in section of both housings properly connected with a cam pin and a cam groove at an engaging position.

As shown in FIGS. 18 and 24, the posture correcting arm 46 of the lever 40 substantially faces the cam plate 47 with the housing main body 11 located therebetween, and is narrower than the cam plate 47 to avoid interference with the retainer 93. The bearing 46A penetrates the posture correcting arm 46 in the thickness direction at a position coaxial with the bearing 47A of the cam plate 47 with respect to the vertical direction, as shown in FIGS. 12 and 27. Escaping grooves 46B and engaging edges 46E are formed at the inner edge of the bearing 46A of the posture correcting arm 46, as shown in FIGS. 15 and 24. The escaping grooves 46B receive the retaining projections 27A and the engaging edges 46E receive the retaining projections 27A substantially in a detaching direction of the lever 40.

A hook 43 is at the leading end of the posture correcting arm 46 and has a hooking surface 43A aligned substantially normal to a rotating direction of the lever 40, as shown in FIGS. 24 and 27. The hook 43 engages the receiving portion 91 of the male housing 80 with the hooking surface 43A opposed to the rear surface of the receiving portion 91 immediately before the lever 40 reaches the connection ending position CEP if the housings 10, 80 are connected while inclined from their proper postures with respect to the width direction WD, as shown in FIG. 15. Further, the hook 43 pulls the receiving portion 91 as the lever 40 is rotated to the connection ending position CEP and corrects the postures of the housings 10, 80.

The operation arm 49 of the lever 40 projects from the rear surface of the housing main body 11 at the connection starting position CSP, as shown in FIGS. 7 and 20. However, the rear end surface of the lever 40 is substantially flush with the rear surface of the housing main body 11 with no step to the rear end of the housing main body 11 at the connection ending position CEP, as shown in FIGS. 10 and 16. Accordingly, whether the housings 10, 80 have been connected properly can be judged by confirming whether the rear end surfaces of the lever 40 and the housing main body 11 are substantially flush with each other.

The male housing 80 is fixed to the outer surface of the electric or electronic device, such as a circuit board, a junction box, an electric or electronic appliance or device, etc., while establishing electrical connection between the male terminal fittings 99 and conductor paths of the electric or electronic device, and is kept on standby until the start of the connecting operation with the female housing 10.

The retainer 93 is inserted into the retainer mount hole 17 of the female housing 10 and is held at the partial locking position. The cam plate 47 of the lever 40 then is slid into the accommodating space 21 of the housing main body 11 so that the bearing 47A of the cam plate 47 engages the supporting shaft 25 and so that the bearing 46A of the posture correcting arm 46 engages the supporting shaft 27 at the opposite side. Thus, the lever 40 is mounted in the housing main body 11 and is at the connection ending position CEP. At this time, the posture correcting arm 46 of the lever 40 and the retainer 93 overlap in the thickness direction. However, the posture correcting arm 46 is in the escaping recess 96 of the retainer 93 to avoid mutual interference.

The female housing 10 is transported to an assembling site and an operator or machine inserts the female terminal fittings 97 into the cavities 12 of the housing main body 11 from behind. The female terminal fittings 97 can be inserted smoothly because there is no step between the rear ends of the lever 40 and the housing main body 11. The shorting terminals 70 and the detecting terminal 60 also may be assembled into the housing main body 11 at this time. The retainer 93 then is pushed to the full locking position and cooperates with the locks 13 to redundantly lock the properly inserted female terminal fittings 97. The lever 40 now can be rotated because the retainer 93 at the full locking position does not project out of the housing main body 11 (see FIGS. 1 through 6 and 12).

Subsequently, the lever 40 is rotated to the connection starting position CSP, as shown in FIGS. 7 and 20. As a result, the tip projection 51A of the temporary holding arm 51 engages the temporarily receiving portion 31 of the housing main body 11. Additionally, the entrance of the cam groove 41 aligns vertically with the entrance of cam-pin introducing groove 22A. The female housings 10 then are fit lightly into the fitting recesses 83 of the receptacle 81 of the male housing 80 and are held in the standby state. Thus, as shown in FIG. 8, each disengaging projection 92 moves between and separates the temporary holding arm 51 and the temporarily receiving portion 31. Additionally, the cam pin 88 enters the cam-pin introducing groove 22A and the cam groove 41, and the lock projection 89 enters the guide groove 22B.

The operating arm 49 then is pressed to rotate the lever 40 in a direction of arrow X shown in FIG. 8. The cam pin 88 moves along the cam-pin introducing groove 22A, the lock projection 89 moves along the guide groove 22B and the short canceling pieces 87 move between the resilient pieces 71 of the shorting terminals 70 and the female terminal fittings 97 at an initial stage of the rotation of the lever 40, as shown in FIG. 2, thereby canceling the shorted state. Further, the pre-pressing portion 45 contacts the pressable portion 66 of the detecting terminal 60 from behind at the initial state of the rotation of the lever 40, and the slants of the pre-pressing portion 45 and the pressable portion 66 slide on each other in the connecting direction CD of the housings 10, 80, to deform the second spring 63. The first springs 62 are pressed down and in as the front end of the second spring 63 inclines so that the contacts 65 of the first springs 62 become lower and more inward than the corresponding contact terminals 98, as shown in FIG. 3. In this way, the first springs 62 are pressed down and in at an early stage of the entrance of the contact terminals 98 into the detecting terminal 60, and the contact terminals 98 are inserted to the back of the detecting terminal 60 while separating from the contact portion 65.

The locking projection 53 of the locking piece 42 moves onto the lock projection 89 as the lever 40 is rotated further, and the locking piece 42 deforms down, as shown in FIG. 4. As a result, the pre-pressing portion 45 moves away from the pressable portion 66 and the front end of the pressing portion 44 presses the pressable portion 66 down. The second spring 63 remains deformed and does not restore resiliently up. Thus, the contacts 65 of the first springs 62 also do not restore resiliently up and remain separated from the contact terminals 98. As shown in FIGS. 5 and 9, the slant of the pressing portion 44 slides on the pressable portion 66 and simultaneously makes an arcuate movement along the rotational path of the lever 40, while the locking projection 53 is passing the lock projection 89. Thus, the first and second springs 62 and 63 remain deformed in the deformation direction DD.

The locking projection 53 of the locking piece 42 move over the lock projection 89, as shown in FIG. 6, when the lever 40 reaches the connection ending position CEP. Thus, the locking piece 42 restores resiliently towards its initial natural state and the pressing portion 44 moves away from the pressable portion 66 to substantially stop pressing. As a result, the first and second springs 62 and 63 are restored resiliently towards their initial natural states. The heights of the contacts 65 of the first springs 62 are raised to push the contact terminals 98 from below and to establish an electrical connection therebetween, thereby closing the detecting circuit. A signal resulting from the connection of the contact terminals 98 and the detecting terminal 60 is detected electrically to indicate that the lever 40 has reached the connection ending position CEP and that the housings 10, 80 have been connected properly. Additionally, a specified circuit is constructed by establishing an electrical connection between the male and female terminal fittings 99, 97.

The cam plate 47 is in the accommodating space 21 of the housing main body 11, the protecting portion 48 is in the protecting-portion accommodating space 21A, and the operation arm 49 is fit into the stepped recess 29B of the housing main body 11 when the lever 40 reaches the connection ending position CEP. Then, as shown in FIGS. 10 and 16, the rear ends of the lever 40 and the housing main body 11 are substantially flush with each other. The arrival of the lever 40 at the connection ending position CEP can be confirmed visually by this flush alignment.

The central axis of rotation of the lever 40 is displaced in the width direction WD, and an engaging area of the cam groove 41 and the cam pin 88 is only in the one cam plate 47 of the lever 40, as shown in FIG. 12. Thus, a connecting force of the lever 40 is skewed to the central axis of rotation and to the engaging area of the cam groove 41 and the cam pin 88. Therefore, the connecting operation is likely to proceed faster at this side while being delayed at a side away from the central axis and opposite to the engaging area of the cam groove 41 and the cam pin 88. However, the hook 43 of the lever 40 hooks and pulls the receiving portion 91, as shown in FIG. 15, substantially immediately before the lever 40 reaches the connection ending position CEP even if the housings 10, 80 are inclined from their proper connecting postures with respect to the vertical direction. In this way, the connecting operation at the side of the posture correcting arm 46 proceeds faster. Therefore, the postures of both housings 10, 80 are corrected to proper connecting postures when the lever 40 reaches the connection ending position CEP.

Further, even if both housings 10, 80 are inclined from their proper connecting postures with respect to the width direction WD, the pushing surface 49A of the operation arm 49 of the lever 40 contacts the contact surface 29A of the housing main body 11 and pushes it toward the receptacle 81 substantially immediately before the lever 40 reaches the connection ending position CEP, as shown in FIG. 13. In this way, the connecting operation at the end away from the central axis, which is apt to delay, is caused to proceed faster. Therefore, the postures of both housings 10, 80 are corrected to proper connecting postures when the lever 40 reaches the connection ending position CEP.

The lock projection 89 slides in contact with the guide groove 22B of the housing main body 11 and the cam pin 88 likewise slides in contact with the cam-pin introducing groove 22A of the housing main body 11 while the housings 10, 80 are being connected. These sliding movements guide the connecting operation of both housings 10, 80 and further prevent inclined postures of the housings 10, 80. The lock projection 89 is between the back end of the guide groove 22B of the cover 22 of the housing main body 11 and the locking projection 53 of the locking piece 42 of the lever 40 when the lever 40 reaches the connection ending position CEP, as shown in FIG. 14. Thus, the locked state of the lever 40 indicates that the housings 10, 80 are in their proper connecting postures.

The housings 10, 80 of a lever-type connector generally are connected by connecting forces that act between the housings 10, 80 as the lever 40 is rotated with the cam pin 88 engaged with the cam groove 41. However, it is difficult to balance the connecting forces between the housings 10, 80 if the lever 40 has only one cam plate 47 arranged on only one surface of the female housing 10. In other words, the connection of the side of the housing 10 that has the cam plate 47 proceeds, while the opposite side is delayed. As a result, the housings 10, 80 may be connected in inclined postures with respect to the height axis. Further, the housings 10, 80 may be connected in postures inclined with respect to the widthwise central axis if the engaged position of the cam pin 88 and the cam groove 41 is displaced with respect to the width direction WD of the housings 10, 80.

On this point, another engaged position is provided upon completing the connecting operation in addition to the engaged position of the cam groove 41 and the cam pin 88, so that the connecting forces are balanced with respect to the width direction and height direction of both housings 10, 80. Thus, the postures of the housings 10, 80 can be corrected into substantially straight connecting postures.

More specifically, the hook 43 of the posture correcting arm 46 engages the receiving portion 91 at a position substantially symmetrical to the engaged position of the cam pin 88 and the cam groove 41 with respect to the heightwise central axis of the housings 10, 80 and produces forces to connect the housings 10, 80 as the connecting operation of the housings 10, 80 is being completed. Thus, the connecting forces are well-balanced manner at the opposite sides of the heightwise central axis of the housings 10, 80, with the result that the housings 10, 80 are corrected into substantially straight connecting postures.

The engaged position of the cam pin 88 and the cam groove 41 is offset from the widthwise central axis of the housings 10, 80. Thus, the female housing 10 may be connected faster with the male connector housing 80 at this engaged side. However, the pushing surface 49A of the operation arm 49 of the lever 40 pushes the female housing 10 into the male connector housing 80 at the widthwise side opposite the engaged position of the cam pin 88 and the cam groove 41 as the connecting operation is being completed. Therefore, the postures of the housings 10, 80 may be corrected into substantially straight connecting postures, if necessary.

Further, the lock projection 89 is guided by the guide groove 22B at the widthwise side substantially opposite to the engaged position of the cam pin 88 and the cam groove 41 to hold a proper connecting posture of the female connector housing 10. The locking piece 42 then engages the lock projection 89 of the male housing 80 to lock the housings 10, 80 in their connected state when the connecting operation is completed.

Insertion of the female terminal fittings into the cavities e.g. by an automatic machine can be difficult if the rear end surface of the lever projects from or is retracted from the rear end surface of the female housing. However, the rear end surface of the lever 40 is substantially flush with the rear end surface of the female housing 10. Thus, the terminal inserting operation is performed smoothly. The flush disposition of the rear end surface of the lever 40 with the rear end surface of the female housing 10 at the connection ending position CEP provides a clear visual indication that the lever 40 has reached the connection ending position CEP and the housings 10, 80 have been connected properly.

Further, the posture correcting arm 46 of the lever 40 is on the bottom surface of the female housing 10 to cover at least part of the bottom surface where the retainer is mounted. The retainer and the posture correcting arm could interfere with each other at the partial locking position where the retainer projects from the outer side surface of the female housing. However, the escaping recess 96 is formed in the pushing surface 93A of the retainer 93 for avoiding interference of the retainer 93 and the lever 40 when the retainer 93 is at the partial locking position. Therefore, the displacements of the retainer 93 and the lever 40 are not hindered.

Furthermore, rotation of the lever 40 is prevented by the contact of the posture correcting arm 46 and the retainer 93 unless the retainer 93 is at the full locking position. Thus, an inability to rotate the lever 40 provides a clear indication that the retainer 93 is left at an intermediate position.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The contact surface of the housing main body may be a substantially flat surface instead of the stepped surface.

The operable member, such as the lever, and the detecting terminal may be assembled into the male housing.

The lever and the male housing are engaged at the position substantially symmetrical to this engaged position of the cam groove and the cam pin with respect to the widthwise central axis WCA of the housings or at the position symmetrical to this engaged position with respect to the heightwise central axis of the housings. In other words, it is sufficient to set at least two positions to produce forces in directions to connect the housings by the mutual engagement of the lever and the male housing when the connecting operation of the housings is completed. Such an additional engaged position may be given by any one of the following combinations: the hook of the lever and the receiving portion of the male housing, the pushing surface of the lever and the contact surface of the housing main body, and the guide groove of the female housing and the lock projection of the male housing.

The operable member is a rotatable lever in the above-described embodiment. However, the operable member may be displaceable along a different path e.g. linearly displaceable like a slider or may follow any other path (such as a substantially elliptical, bent or other non-linear path).

The operable member may be provided with two or more cam plates engageable with a corresponding number of cam pins on the housing, with the cam plates being arranged in a non-symmetric manner with respect to the housing (e.g. displaced with respect to the widthwise and/or heightwise central axis of the housings).

The rear end surface of the lever may be flush with that of the female housing when the lever is at the connection ending position, and also when the lever is at the connection starting position or at a connection intermediate position if the lever can be kept stopped during the connection.

The escaping recess may be formed in the inner side surface of the posture correcting arm of the lever.

The retainer and the cam plate may be in an overlapping positional relationship and the escaping recess may be formed in the cam plate.

The lever may be comprised of an operable portion, arm plates projecting from the opposite ends of the operable portion, and a cam groove in each arm plate.

The invention is also applicable to lever-type connectors in which a lever is mounted on a male connector housing.

What is claimed is:

1. A connector, comprising:

a housing having opposite top and bottom walls and top and bottom supporting shafts projecting outwardly from the top and bottom walls substantially coaxially with one another; and a movable member having an operation arm, a cam plate projecting from one end of the operation arm and a posture correcting plate projecting from an opposite end of the operation arm so that the cam plate and the posture correcting arm are substantially opposed to one another, the cam plate and the posture correcting arm being rotatably mounted to the supporting shaft of the housing so that the movable member is displaceable between an initial position and a connection ending position, the cam plate being formed with a cam groove for connecting the housing with a mating housing, the posture correcting arm being formed with a hook spaced from the operation arm, the cam groove and the hook engaging the mating housing thereby setting at least two positions to produce forces in directions to connect the housings during a connecting operation of the housings.

2. The connector of claim 1, wherein the movable member arranged so that the engaged position of the cam groove with the cam pin is displaced towards one side from the widthwise central axis of the housings and an operation arm is provided at an opposite side with respect to the widthwise central axis for operating the movable member, and the movable member having a pushing surface for pushing the housing into the mating connector housing during the connecting operation.

3. A connector, comprising:

a housing; and a movable member operably mounted to the housing and being displaceable between an initial position and a connection ending position, the movable member having a cam plate formed with a cam groove for connecting the housing with a mating housing, at least one of the housing and the movable member having posture correcting means spaced substantially symmetrically from the cam groove and from the mating housing for engagement at a position substantially symmetrical to the engaged position with respect to at least one of a widthwise central axis of both housings and heightwise central axis of the both housings, thereby setting at least two positions to produce forces in directions to connect the housings during a connecting operation of the housings wherein the housing has a cam-plate accommodating wall, an accommodating space being defined between the cam-plate accommodating wall and an outer surface of the housing for movably accommodating the cam plate, the cam-plate accommodating wall being formed with a cam-pin introducing groove at a position displaced towards one side from the widthwise central axis of the housings and a guide groove at a position displaced towards the opposite side for receiving a lock projection of the mating housing, the cam-pin introducing groove and the guide groove extending substantially in connecting directions of the housings.

4. The connector of claim 3, wherein the cam plate has a locking piece facing the guide groove and being engageable with the lock projection when the housings are connected.

5. The connector of claim 1, wherein a rear end surface of the movable member (40) is substantially flush with a rear end surface of the housing (10) at a connection ending position (CEP).

6. A connector, comprising:

a housing; and a movable member operably mounted to the housing and being displaceable between an initial position and a connection ending position, the movable member having a cam plate formed with a cam groove for connecting the housing with a mating housing, at least one of the housing and the movable member having posture correcting means spaced substantially symmetrically from the cam groove and from the mating housing for engagement at a position substantially symmetrical to the enabled position with respect to at least one of a widthwise central axis of both housings and heightwise central axis of the both housings, thereby setting at least two positions to produce forces in directions to connect the housings by during a connecting operation of the housings wherein the movable member has a side plate with a central axis of rotation, the movable member covering at least a part of an outer side surface of the housing, the housing having at least one cavity for receiving a terminal fitting, a retainer mounted through the outer side surface of the housing where the side plate, the retainer being movable between a first position where insertion and withdrawal of the terminal fitting into and from the cavity are permitted and a second position for retaining the terminal fitting that has been inserted properly into the cavity, a pushing surface of the retainer projecting from the outer side surface of the housing at the first position, and one of the inner side surface of the side plate and the pushing surface of the retainer is formed with an escaping recess for avoiding mutual interference of the movable member and the retainer when the retainer is at the first position.

7. The connector of claim 6, wherein movement of the movable member is prevented by the contact of the side plate and the retainer in a rotating direction unless the retainer is at the second position.

* * * * *